US009884406B2

(12) United States Patent
Hashish et al.

(10) Patent No.: US 9,884,406 B2
(45) Date of Patent: Feb. 6, 2018

(54) HIGH-PRESSURE WATERJET CUTTING HEAD SYSTEMS, COMPONENTS AND RELATED METHODS

(71) Applicant: Flow International Corporation, Kent, WA (US)

(72) Inventors: Mohamed A. Hashish, Bellevue, WA (US); Steven J. Craigen, Auburn, WA (US); Bruce M. Schuman, Auburn, WA (US)

(73) Assignee: FLOW INTERNATIONAL CORPORATION, Kent, WA (US)

( * ) Notice: Subject to any disclaimer, the term of this patent is extended or adjusted under 35 U.S.C. 154(b) by 558 days.

(21) Appl. No.: 14/156,315

(22) Filed: Jan. 15, 2014

(65) Prior Publication Data

US 2015/0196989 A1 Jul. 16, 2015

(51) Int. Cl.
*B24C 5/04* (2006.01)
*B24C 5/02* (2006.01)
(Continued)

(52) U.S. Cl.
CPC ..... *B24C 5/04* (2013.01); *B24C 1/045* (2013.01); *B24C 5/02* (2013.01); *B24C 7/0007* (2013.01);
(Continued)

(58) Field of Classification Search
CPC B24C 1/006; B24C 1/045; B24C 1/08; B24C 5/02; B24C 5/04; B24C 7/0007;
(Continued)

(56) References Cited

U.S. PATENT DOCUMENTS 2,658,312 A 11/1953 Smith
4,412,402 A * 11/1983 Gallant ..... A61C 3/025 433/216
(Continued)

FOREIGN PATENT DOCUMENTS

CN 2246028 Y 1/1997
CN 2406979 Y 11/2000
(Continued)

OTHER PUBLICATIONS

Luo, "Cutting Composite with High Pressure Water Jets," *5th Pacific Rim International Conference on Water Jet Technology*, Feb. 3-5, 1998, New Delhi, India, 11 pages.

*Primary Examiner* — Eileen Morgan
(74) *Attorney, Agent, or Firm* — Seed IP Law Group LLP

(57) ABSTRACT

A waterjet cutting head assembly is provided which includes an orifice unit to generate a high-pressure waterjet, a nozzle body and a nozzle component coupled to the nozzle body with the orifice unit positioned therebetween. The nozzle component may include a waterjet passage, at least one jet alteration passage and at least one environment control passage. The jet alteration passage may intersect with the waterjet passage to enable selective alteration of the waterjet during operation via the introduction of a secondary fluid or application of a vacuum. The environment control passage may include one or more downstream portions aligned relative to the fluid jet passage so that gas passed through the environment control passage during operation is directed to impinge on an exposed surface of a workpiece at or adjacent to a location where the waterjet is cutting the workpiece. Other high-pressure waterjet cutting systems, components and related methods are also provided.

25 Claims, 12 Drawing Sheets

(51) Int. Cl.
*B24C 1/04* (2006.01)
*B26F 3/00* (2006.01)
*B24C 7/00* (2006.01)

(52) U.S. Cl.
CPC ..... *B24C 7/0046* (2013.01); *B24C 7/0076* (2013.01); *B24C 7/0084* (2013.01); *B26F 3/004* (2013.01); *Y10T 83/0591* (2015.04)

(58) Field of Classification Search
CPC ... B24C 7/0046; B24C 7/0076; B24C 7/0084; B26F 3/004; Y10T 83/0591
USPC ..... 451/36, 37, 38, 39, 40
See application file for complete search history.

(56) References Cited

U.S. PATENT DOCUMENTS 4,478,368 A * 10/1984 Yie ..... B05B 7/1431 239/430
4,555,872 A * 12/1985 Yie ..... B05B 7/1431 451/102
4,563,688 A 1/1986 Braun
4,765,540 A 8/1988 Yie
4,849,769 A 7/1989 Dressler
4,934,111 A 6/1990 Hashish et al.
4,942,284 A 7/1990 Etcheparre et al.
5,065,789 A 11/1991 Eslinger
5,643,058 A * 7/1997 Erichsen ..... B24C 1/045 451/100
5,794,858 A 8/1998 Munoz
6,001,219 A 12/1999 Caspar
6,103,049 A * 8/2000 Batdorf ..... B26F 3/004 156/251
6,204,475 B1 * 3/2001 Nakata ..... B23K 26/147 219/121.84
6,220,529 B1 * 4/2001 Xu ..... B24C 1/045 137/872
6,280,302 B1 8/2001 Hashish et al.
6,315,215 B1 11/2001 Gipson et al.
6,464,567 B2 10/2002 Hashish et al.
6,492,617 B2 * 12/2002 Nagahori ..... B23K 26/1494 219/121.7
6,752,686 B1 6/2004 Hashish et al.
6,755,725 B2 6/2004 Hashish et al.
6,766,216 B2 * 7/2004 Erichsen ..... B24C 1/045 700/159
6,875,084 B2 4/2005 Hashish et al.
7,591,615 B2 9/2009 Li et al.
7,594,614 B2 9/2009 Vijay et al.
7,703,363 B2 4/2010 Knaupp et al.
8,047,798 B2 11/2011 Bech
8,210,908 B2 7/2012 Hashish
8,322,700 B2 12/2012 Saberton et al.
8,448,880 B2 5/2013 Hashish et al.
8,550,873 B2 * 10/2013 Vijay ..... B05B 1/083 239/101
8,894,903 B2 11/2014 Bakker et al.
2003/0037650 A1 2/2003 Knaupp et al.
2005/0017091 A1 1/2005 Olsen et al.
2008/0057839 A1 3/2008 Anderson et al.
2008/0216625 A1 9/2008 Li et al.
2009/0071303 A1 3/2009 Hashish et al.
2009/0140482 A1 6/2009 Saberton et al.
2009/0255602 A1 * 10/2009 McMasters ..... B23P 6/007 138/115
2009/0288532 A1 11/2009 Hashish
2009/0305611 A1 12/2009 Anton et al.
2010/0173570 A1 7/2010 Reukers
2010/0224543 A1 9/2010 Ellis et al.
2011/0113940 A1 5/2011 Florean
2012/0021676 A1 * 1/2012 Schubert ..... B24C 1/045 451/38
2012/0085211 A1 * 4/2012 Liu ..... B24C 1/045 83/53
2012/0247296 A1 10/2012 Stang et al.
2012/0315824 A1 12/2012 Jarchau et al.
2012/0322347 A1 12/2012 Molz et al.
2013/0025422 A1 * 1/2013 Chillman ..... B24C 1/045 83/53
2013/0112056 A1 5/2013 Chacko et al.
2014/0116217 A1 * 5/2014 Hashish ..... B24C 5/02 83/177
2014/0165807 A1 * 6/2014 David ..... B05B 13/0636 83/177

FOREIGN PATENT DOCUMENTS

CN 2850822 Y 12/2006
CN 2895428 Y 5/2007
CN 201177121 Y 1/2009
CN 202213012 U 5/2012
CN 103272799 A 9/2013
DE 4120613 A1 3/1992
DE 29920344 U1 3/2000
DE 19849814 A1 5/2000
DE 10051942 A1 5/2002
DE 10308330 A1 9/2004
EP 1820604 A1 8/2007
EP 2230397 A1 9/2010
FR 2480171 A1 10/1981
FR 2754331 A1 4/1998
JP 1159173 A 6/1989
JP 0623670 A 2/1994
JP 2000034721 A 2/2000
JP 2011-11314 A 1/2011
KR 10-2001-0025910 A 4/2001
KR 10-0873900 B1 12/2008
KR 10-2012-0031027 A 3/2012
WO 2014/111213 A2 7/2014

* cited by examiner

HIGH-PRESSURE WATERJET CUTTING HEAD SYSTEMS, COMPONENTS AND RELATED METHODS

BACKGROUND

Technical Field

This disclosure is related to high-pressure waterjet cutting systems, components thereof and related methods, and, in particular, to nozzle components of high-pressure waterjet cutting heads and related methods that are well suited for cutting workpieces with high precision using a pure waterjet or abrasive waterjet.

Description of the Related Art

Waterjet or abrasive waterjet systems are used for cutting a wide variety of materials, including stone, glass, ceramics and metals. In a typical waterjet system, high-pressure water flows through a cutting head having a nozzle which directs a cutting jet onto a workpiece. The system may draw or feed abrasive media into the high-pressure waterjet to form a high-pressure abrasive waterjet. The cutting head may then be controllably moved across the workpiece to cut the workpiece as desired, or the workpiece may be controllably moved beneath the waterjet or abrasive waterjet. Systems for generating high-pressure waterjets are currently available, such as, for example, the Mach 4™ five-axis waterjet system manufactured by Flow International Corporation, the assignee of the present application. Other examples of waterjet systems are shown and described in Flow's U.S. Pat. No. 5,643,058, which is incorporated herein by reference in its entirety.

Abrasive waterjet cutting systems are advantageously used when cutting workpieces made of carbon fiber reinforced plastic or other composite materials to meet exacting standards; however, the use of abrasives introduces complexities and abrasive systems can suffer from other drawbacks, including containment and management of spent abrasives. Although pure waterjet systems may solve some of the drawbacks and avoid some of the complexities of abrasive waterjet systems, known systems that use pure waterjets unladen with abrasives are generally insufficient for cutting workpieces made of carbon fiber reinforced plastic or other similar composite materials to exacting standards.

BRIEF SUMMARY

Embodiments described herein provide high-pressure waterjet systems, waterjet cutting head assemblies, nozzle components and related methods which are particularly well adapted for cutting composite materials with a pure waterjet to meet exacting standards. Embodiments include nozzle components having compact and efficient form factors which are configured to clear a cutting location of obstructions such as standing fluid droplets and particulate matter during cutting operations which might otherwise impede a path of the waterjet and cause surface irregularities or anomalies at the cut surface. The nozzle components may also enable selective alteration of the waterjet via the introduction of a secondary fluid or application of a vacuum, which may lead to a reduction in the occurrence of surface defects (e.g., delamination) that might otherwise arise during activities such as drilling and piercing. Still further, the nozzle components may be configured to detect a condition of an orifice unit or member that is used to generate the waterjet. Accordingly, the orifice unit or member can be replaced as its condition deteriorates below an acceptable level to maintain cutting performance. Embodiments may also be readily convertible between a pure waterjet cutting configuration and an abrasive waterjet cutting configuration to provide additional functionality and processing flexibility.

In one embodiment, a nozzle component of a high-pressure waterjet cutting system may be summarized as including a unitary body having: a waterjet passage extending through the unitary body along an axis, the waterjet passage including an inlet at an upstream end thereof and an outlet at a downstream end thereof; at least one jet alteration passage extending through the unitary body and intersecting with the waterjet passage between the inlet and the outlet thereof to enable selective alteration of a waterjet during operation as the waterjet travels through the waterjet passage and is discharged through the outlet; and at least one environment control passage extending through the unitary body and having at least a downstream portion aligned relative to the fluid jet passage so that gas passed through the environment control passage during operation is directed to impinge on the workpiece at or adjacent a waterjet impingement location.

The unitary body may further include a condition detection passage extending through the unitary body and intersecting with the waterjet passage between the inlet and the outlet thereof to enable detection of a condition of an upstream component that generates the waterjet. The unitary body may be formed from an additive manufacturing or casting process. The unitary body may further include a first port in fluid communication with the jet alteration passage for coupling the jet alteration port to a secondary fluid source and a second port in fluid communication with the environment control passage for coupling the environment control passage to a pressurized gas source. The unitary body may further include an orifice mount receiving cavity and a vent passage extending between the orifice mount receiving cavity and an external environment of the nozzle component.

The jet alteration passage may include a generally annular portion that encircles the waterjet passage. The jet alteration passage may include a plurality of bridge passageways each extending between the generally annular portion and the waterjet passage. The plurality of bridge passageways may be spaced circumferentially about the waterjet passage in a regular pattern. Each of the bridge passageways may include a downstream end configured to discharge a secondary fluid into the waterjet passage at an angle that is inclined toward the outlet of the waterjet passage. The jet alteration passage may include a plurality of distinct sub-passageways that may be configured to simultaneously discharge a secondary fluid from a common secondary fluid source into a path of the waterjet passing through the waterjet passage during operation.

The environment control passage may include a generally annular portion that encircles the waterjet passage. The environment control passage may include a plurality of distinct sub-passageways each extending between the generally annular portion and an external environment of the nozzle component. The plurality of distinct sub-passageways of the environment control passage may be spaced circumferentially about the waterjet passage in a regular pattern. Each of the distinct sub-passageways of the environment control passage may include a downstream end configured to discharge gas to impinge on the workpiece at or adjacent the waterjet impingement location. The environment control passage may include a plurality of distinct sub-passageways that may be configured to simultaneously discharge gas from a common pressurized gas source to impinge on the workpiece at or adjacent the waterjet impingement location during operation.

A cutting head assembly of a high-pressure waterjet cutting system may be summarized as including an orifice unit through which water passes during operation to generate a high-pressure waterjet for cutting a workpiece; a nozzle body including a fluid delivery passage to route water toward the orifice unit; and a nozzle component coupled to the nozzle body with the orifice unit positioned therebetween. The nozzle component may include: a waterjet passage extending through the unitary body along an axis, the waterjet passage including an inlet at an upstream end thereof and an outlet at a downstream end thereof; at least one jet alteration passage extending through the unitary body and intersecting with the waterjet passage between the inlet and the outlet thereof to enable selective alteration of the waterjet during operation as the waterjet travels through the waterjet passage and is discharged through the outlet; and at least one environment control passage extending through the unitary body and having at least a downstream portion aligned relative to the fluid jet passage so that gas passed through the environment control passage during operation is directed to impinge on the workpiece at or adjacent a waterjet impingement location. The nozzle component may further include a condition detection passage extending therethrough and intersecting with the waterjet passage between the inlet and the outlet thereof to enable detection of a condition of the orifice unit. The nozzle component may further include a nozzle body cavity and a vent passage extending between the nozzle body cavity and an external environment.

In some instances, the at least one jet alteration passage may be an abrasive media passage that intersects with the waterjet passage to enable selective introduction of abrasive media into the high-pressure waterjet during an abrasive waterjet cutting operation. The cutting head assembly may further include a mixing tube removably coupled to the nozzle component within the waterjet passage thereof to receive the high-pressure waterjet along with abrasive media from the at least one jet alteration passage, to mix the high-pressure waterjet and the abrasive media, and to discharge a resulting abrasive waterjet therefrom.

A method of cutting a workpiece may be summarized as including directing a waterjet onto a surface of a workpiece that is exposed to the surrounding atmosphere and simultaneously directing a gas stream onto the exposed surface of the workpiece at or adjacent a cutting location to maintain a cutting environment at the cutting location that is, apart from the waterjet, substantially devoid of fluid or particulate matter. The method may further include moving a source of the waterjet relative to the workpiece to cut the workpiece along a desired path while continuously directing the gas stream onto the exposed surface of the workpiece at or adjacent the cutting location. Directing the waterjet onto the exposed surface of the workpiece may include directing a waterjet unladened with abrasives. Directing the waterjet onto the exposed surface of the workpiece may include directing a pure waterjet onto a composite workpiece. The method may further include introducing a secondary fluid into the waterjet to alter the waterjet during at least a portion of a cutting operation. The method may further include, after a first workpiece processing operation in which the waterjet is unladened with abrasives, attaching a mixing tube to a source of the waterjet and thereafter directing an abrasive waterjet onto the surface of the workpiece or a different workpiece during a second workpiece processing operation.

DETAILED DESCRIPTION

Figure 1:
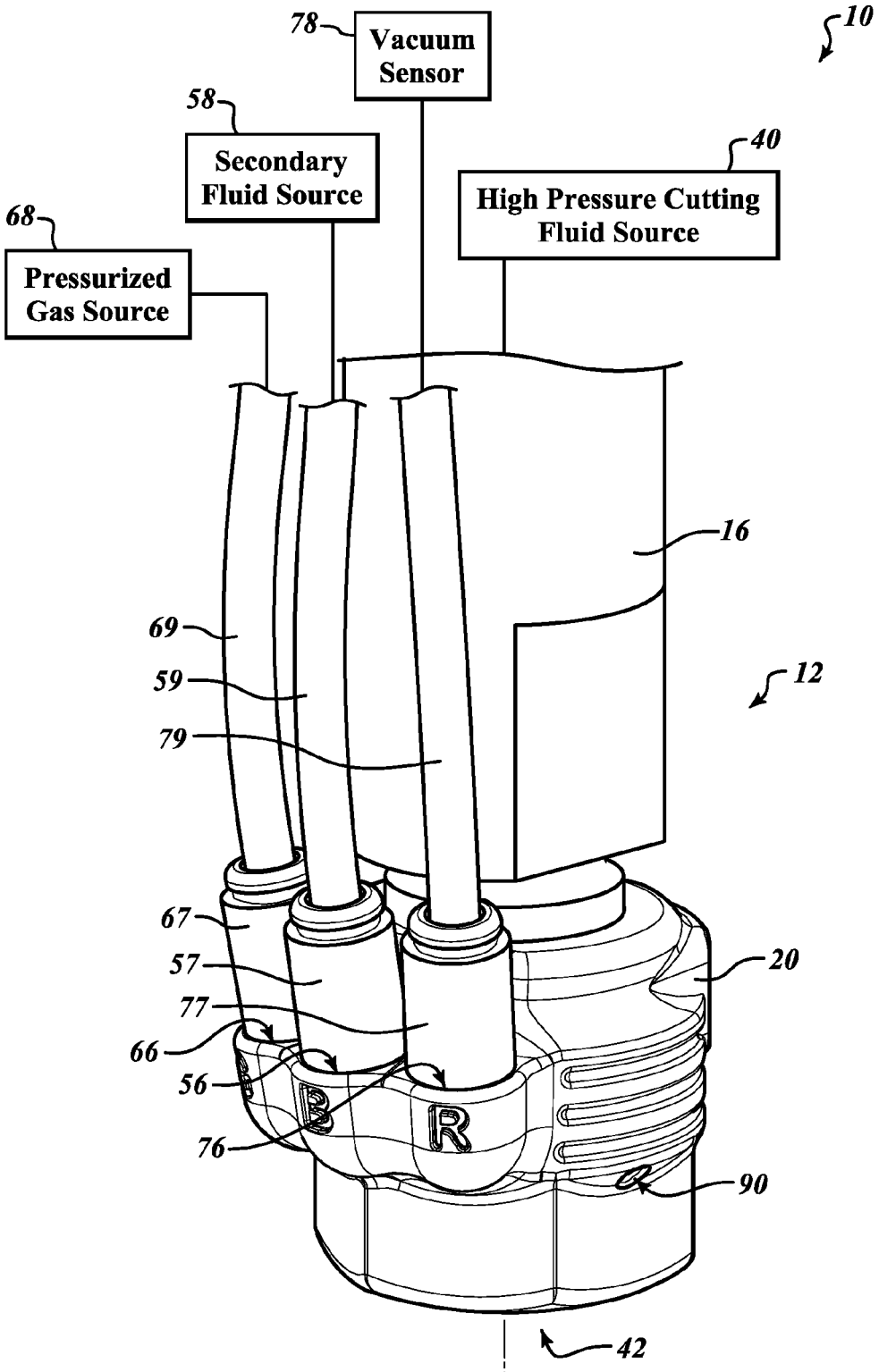
FIG. 1 is an isometric view of a portion of a cutting head assembly of a high-pressure waterjet system, according to one embodiment.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with waterjet cutting systems and methods of operating the same may not be shown or described in detail to avoid unnecessarily obscuring descriptions of the embodiments. For instance, it will be appreciated by those of ordinary skill in the relevant art that an abrasive source may be provided to feed abrasives to a cutting head assembly of the waterjet systems described herein to facilitate, for example, high-pressure abrasive waterjet cutting or processing of workpieces and work surfaces. As another example, well know control systems and drive components may be integrated into the waterjet systems to facilitate movement of the waterjet cutting head assembly relative to the workpiece or work surface to be processed. These systems may include drive components to manipulate the cutting head about multiple rotational and translational axes, as is common in five-axis abrasive waterjet cutting systems. Example waterjet systems may include a waterjet cutting head assembly coupled to a gantry-type motion system, a robotic arm motion system or other conventional motion system.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide high-pressure waterjet systems, waterjet cutting head assemblies, nozzle components and related methods which are particularly well adapted for cutting composite materials with a pure waterjet or abrasive waterjet to meet exacting standards. Embodiments include nozzle components having compact and efficient form factors which are configured to clear a cutting location of obstructions such as standing fluid and particulate matter during cutting operations that might otherwise impede a path of the waterjet and cause surface irregularities or anomalies at the cut surface. The nozzle components may also enable selective alteration of the waterjet via the introduction of a secondary fluid or application of a vacuum. Still further, the nozzle components may be configured to detect a condition of an orifice unit or member that is used to generate the waterjet. The nozzle components may include other features and functionality as described herein. Embodiments may also be readily convertible between a pure waterjet cutting configuration and an abrasive waterjet cutting configuration to provide additional functionality and processing flexibility.

As used herein, the term cutting head or cutting head assembly may refer generally to an assembly of components at a working end of the waterjet machine or system, and may include, for example, an orifice, such as a jewel orifice, through which fluid passes during operation to generate a high-pressure waterjet, a nozzle component (e.g., nozzle nut) for discharging the high-pressure waterjet and surrounding structures and devices coupled directly or indirectly thereto to move in unison therewith. The cutting head may also be referred to as an end effector or nozzle assembly.

The waterjet system may operate in the vicinity of a support structure which is configured to support a workpiece to be processed by the system. The support structure may be a rigid structure or a reconfigurable structure suitable for supporting one or more workpieces (e.g., composite aircraft parts) in a position to be cut, trimmed or otherwise processed. Examples of suitable workpiece support structures include those shown and described in Flow's U.S. application Ser. No. 12/324,719, filed Nov. 26, 2008, and published as US 2009/0140482, which is incorporated herein by reference in its entirety.

The waterjet system may further include a bridge assembly which is movable along a pair of base rails. In operation, the bridge assembly can move back and forth along the base rails with respect to a translational axis to position a cutting head of the system for processing the workpiece. A tool carriage may be movably coupled to the bridge assembly to translate back and forth along another translational axis, which is aligned perpendicularly to the aforementioned translational axis. The tool carriage may be configured to raise and lower the cutting head along yet another translational axis to move the cutting head toward and away from the workpiece. One or more manipulable links or members may also be provided intermediate the cutting head and the tool carriage to provide additional functionally.

For example, the waterjet system may include a forearm rotatably coupled to the tool carriage for rotating the cutting head about an axis of rotation and a wrist rotatably coupled to the forearm to rotate the cutting head about another axis of rotation that is non-parallel to the aforementioned rotational axis. In combination, the rotational axes of the wrist and forearm can enable the cutting head to be manipulated in a wide range of orientations relative to the workpiece to facilitate, for example, cutting of complex profiles. The rotational axes may converge at a focal point which, in some embodiments, may be offset from the end or tip of a nozzle component of the cutting head. The end or tip of the nozzle component of the cutting head is preferably positioned at a desired standoff distance from the workpiece or work surface to be processed. The standoff distance may be selected or maintained at a desired distance to optimize the cutting performance of the waterjet.

During operation, movement of the cutting head with respect to each of the translational axes and one or more rotational axes may be accomplished by various conventional drive components and an appropriate control system. The control system may generally include, without limitation, one or more computing devices, such as processors, microprocessors, digital signal processors (DSP), application-specific integrated circuits (ASIC), and the like. To store information, the control system may also include one or more storage devices, such as volatile memory, non-volatile memory, read-only memory (ROM), random access memory (RAM), and the like. The storage devices can be coupled to the computing devices by one or more buses. The control system may further include one or more input devices (e.g., displays, keyboards, touchpads, controller modules, or any other peripheral devices for user input) and output devices (e.g., displays screens, light indicators, and the like). The control system can store one or more programs for processing any number of different workpieces according to various cutting head movement instructions. The control system may also control operation of other components, such as, for example, an abrasive media source, a secondary fluid source, a vacuum device and/or a pressurized gas source coupled to the abrasive waterjet cutting head assemblies and components described herein. The control system, according to one embodiment, may be provided in the form of a general purpose computer system. The computer system may include components such as a CPU, various I/O components, storage, and memory. The I/O components may include a display, a network connection, a computer-readable media drive, and other I/O devices (a keyboard, a mouse, speakers, etc.). A control system manager program may be executing in memory, such as under control of the CPU, and may include functionality related to, among other things, routing high-pressure water through the waterjet systems described herein, providing a flow of secondary fluid to adjust or modify the coherence of a discharged fluid jet and/or providing a pressurized gas stream to provide for unobstructed waterjet cutting of an exposed workpiece surface.

Further example control methods and systems for abrasive waterjet systems, which include, for example, CNC functionality, and which are applicable to the waterjet systems described herein, are described in Flow's U.S. Pat. No. 6,766,216, which is incorporated herein by reference in its entirety. In general, computer-aided manufacturing (CAM) processes may be used to efficiently drive or control a cutting head along a designated path, such as by enabling two-dimensional or three-dimensional models of workpieces generated using computer-aided design (i.e., CAD models) to be used to generate code to drive the machines. For example, in some instances, a CAD model may be used to generate instructions to drive the appropriate controls and motors of a waterjet system to manipulate the cutting head about various translational and/or rotational axes to cut or process a workpiece as reflected in the CAD model. Details of the control system, conventional drive components and other well known systems associated with waterjet and abrasive waterjet systems, however, are not shown or described in detail to avoid unnecessarily obscuring descriptions of the embodiments.

Other well known systems associated with waterjet systems may also be provided such as, for example, a high-pressure fluid source (e.g., direct drive and intensifier pumps with pressure ratings ranging from about 20,000 psi to 100,000 psi and higher) for supplying high-pressure fluid to the cutting head and/or an abrasive source (e.g., abrasive hopper and abrasive distribution system) for supplying abrasive media to the cutting head to enable abrasive waterjet processing activities, if desired. In some embodiments, a vacuum device may be provided to assist in drawing abrasives into the high-pressure water from the fluid source to produce abrasive waterjets.

According to some embodiments, for example, a high-pressure waterjet system is provided which includes a pump, such as, for example, a direct drive pump or intensifier pump, to selectively provide a source of high-pressure water at an operating pressure of at least 20,000 psi, and in some instances, at or above 60,000 psi or between about 60,000 psi and about 110,000 psi. The high-pressure waterjet system further includes a cutting head assembly that is configured to receive the high-pressure water supplied by the pump and to generate a high-pressure waterjet for processing workpieces or work surfaces. A fluid distribution system in fluid communication with the pump and the cutting head assembly is also provided to assist in routing high-pressure water from the pump to the cutting head assembly.

Figure 2:
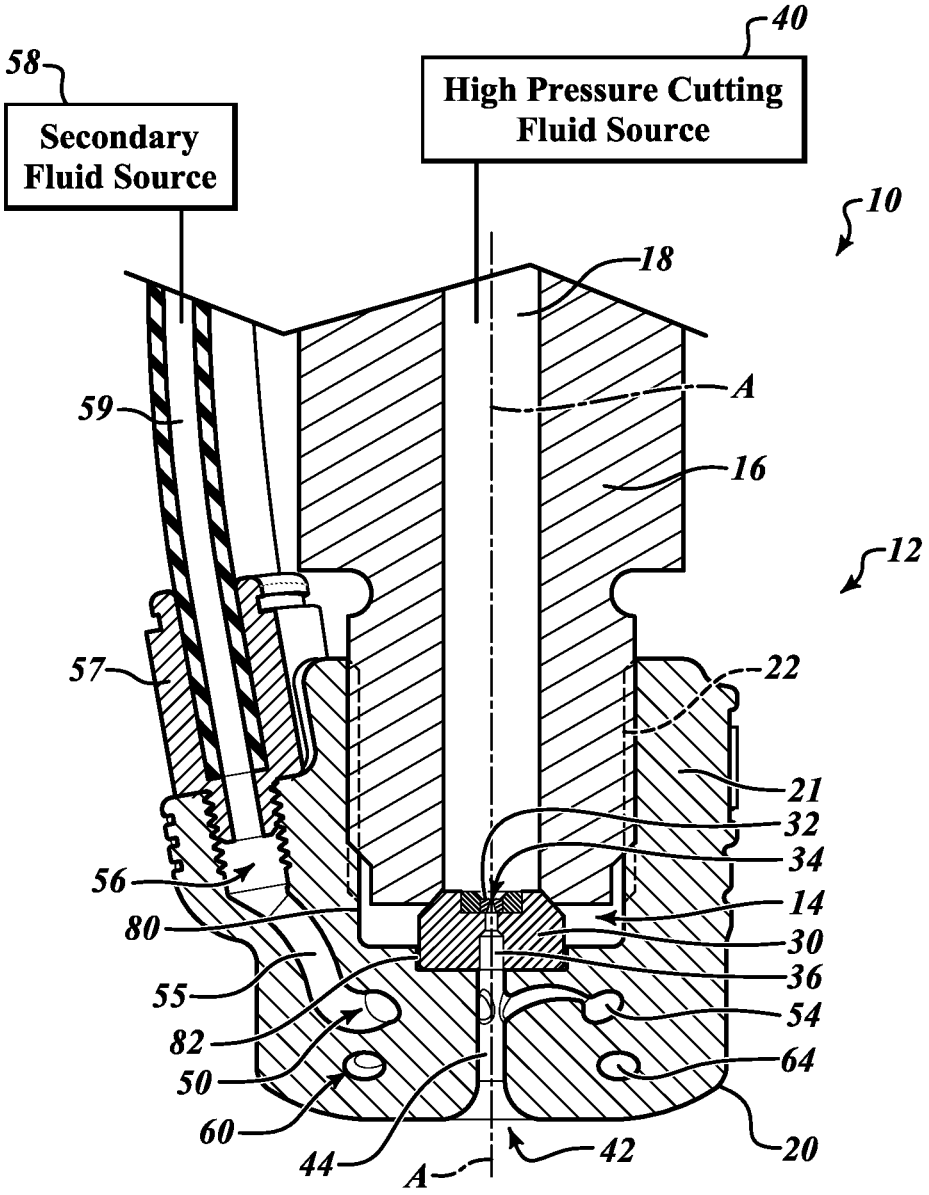
FIG. 2 is a cross-sectional side view of the portion of the cutting head assembly shown in FIG. 1.
Figure 3:
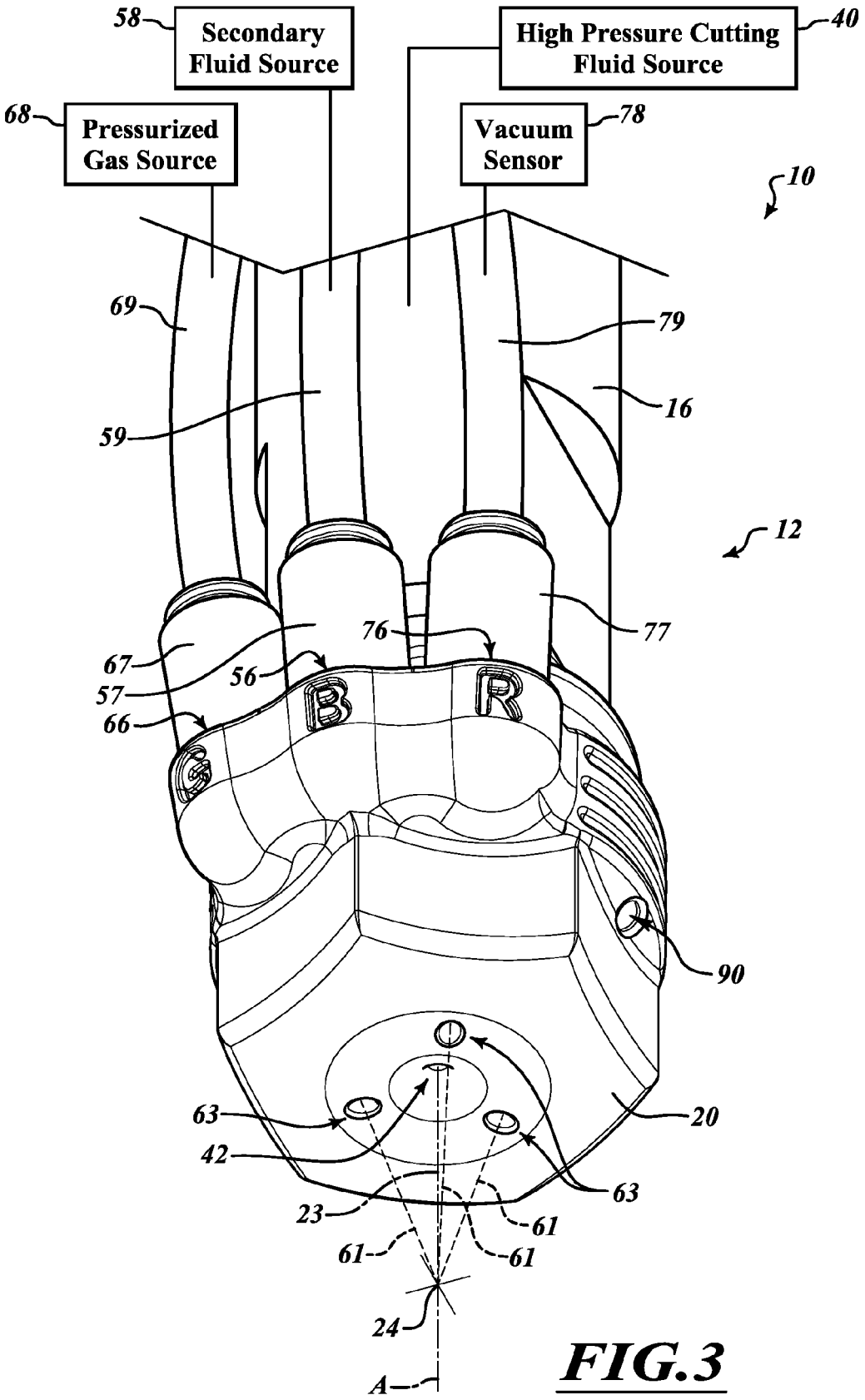
FIG. 3 is a skewed isometric view of the portion of the cutting head assembly of FIG. 1 showing the cutting head assembly from another viewpoint.

FIGS. 1 through 3 show one example of a portion of a fluid jet cutting system 10 that includes a cutting head assembly 12 that is particularly well suited for, among other things, cutting workpieces made of composite materials, such as carbon fiber reinforced plastics, with a pure waterjet.

With reference to the cross-section shown in FIG. 2, the cutting head assembly 12 includes an orifice unit 14 through which a cutting fluid (e.g., water) passes during operation to generate a high-pressure fluid jet. The cutting head assembly 12 further includes a nozzle body 16 having a fluid delivery passage 18 extending therethrough to route cutting fluid toward the orifice unit 14. A nozzle component 20 is coupled to the nozzle body 16 with the orifice unit 14 positioned or sandwiched therebetween. The nozzle component 20 may be removably coupled to the nozzle body 16, for example, by a threaded connection 22 or other coupling arrangement. Coupling of the nozzle component 20 to the nozzle body 16 may urge the orifice unit 14 into engagement with the nozzle body 16 to create a seal therebetween.

The nozzle component 20 can have a one-piece construction and can be made, in whole or in part, of one or more metals (e.g., steel, high strength metals, etc.), metal alloys, or the like. The nozzle component 20 may include threads or other coupling features for coupling to other components of cutting head assembly 12.

The orifice unit 14 may include an orifice mount 30 and an orifice member 32 (e.g., jewel orifice) supported thereby for generating a high-pressure fluid jet as high-pressure fluid (e.g., water) passes through an opening 34 in the orifice member 32. A fluid jet passage 36 may be provided in the orifice mount 30 downstream of the orifice member 32 through which the jet passes during operation. The orifice mount 30 is fixed with respect to the nozzle component 20 and includes a recess dimensioned to receive and hold the orifice member 32. The orifice member 32, in some embodiments, is a jewel orifice or other fluid jet or cutting stream producing device used to achieve the desired flow characteristics of the resultant fluid jet. The opening of the orifice member 32 can have a diameter in a range of about 0.001 inch (0.025 mm) to about 0.02 inch (0.5 mm). Openings with other diameters can also be used, if needed or desired.

As shown in FIG. 2, the nozzle body 16 may be coupled to a high-pressure cutting fluid source 40, such as, for example, a source of high-pressure water (e.g., a direct drive or intensifier pump). During operation, high-pressure fluid (e.g., water) from the cutting fluid source 40 may be controllably fed into the fluid delivery passage 18 of the nozzle body 16 and routed toward the orifice unit 14 to generate the jet (not shown), which is ultimately discharged from the cutting head assembly 12 through an outlet 42 at the terminal end of a waterjet passage 44 that extends through the nozzle component 20 along a longitudinal axis A thereof.

Further details of internal passages of the nozzle component 20, including the waterjet passage 44, are shown and described with reference to FIGS. 4 through 6.

Figure 4:
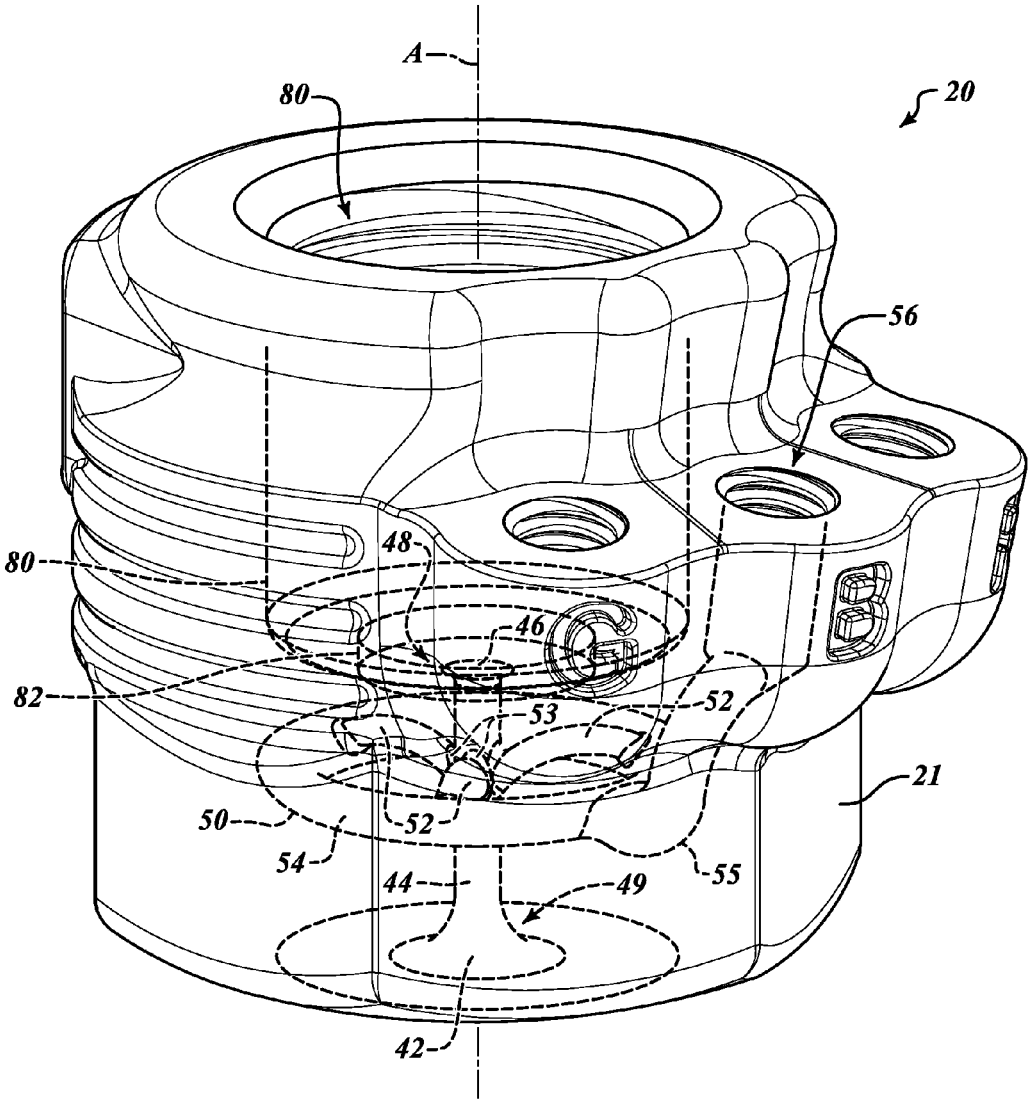
FIG. 4 is an isometric view of a fluid distribution component of the cutting head assembly shown in FIG. 1 from one viewpoint, showing one of several internal passages thereof.

With reference to FIG. 4, the waterjet passage 44 is shown extending through a body 21 of the nozzle component 20 along longitudinal axis A. The waterjet passage 44 includes an inlet 46 at an upstream end 48 thereof and the outlet 42 at a downstream end 49 thereof.

At least one jet alteration passage 50 may be provided within the nozzle component 20 for adjusting, modifying or otherwise altering the jet that is discharged from the outlet 42 of the nozzle component 20. The jet alteration passage 50 may extend through the body 21 of the nozzle component 20 and intersect with the waterjet passage 44 between the inlet 46 and the outlet 42 thereof to enable such alteration of the waterjet during operation. More particularly, jet alteration passage 50 may extend through the body 21 of the nozzle component 20 and include one or more downstream portions 52 that intersect with the waterjet passage 44 so that a secondary fluid passed through the jet alteration passage 50 during operation may be directed to impact the fluid jet traveling therethrough. As an example, the jet alteration passage 50 may include a plurality of distinct downstream portions 52 that are arranged such that respective secondary fluid streams discharged therefrom impact the fluid jet traveling through the waterjet passage 44. The example embodiment shown in FIG. 4 includes three distinct downstream portions 52 that are arranged in this manner; however, it is appreciated that two, four or more downstream passage portions 52 may be arranged in such a manner.

Two or more of the downstream portions 52 of the passage 50 may join at an upstream junction 54. The upstream junction 54 may be, for example, a generally annular passage portion that is in fluid communication with an upstream end of each of the downstream passage portions 52, as shown in FIG. 4. The downstream portions 52 of the jet alteration passage 50 may be bridge passageways that extend between the generally annular passage portion and the waterjet passage 44. The bridge passageways may be spaced circumferentially about the waterjet passage 44 in a regular pattern. For example, the downstream portions 52 shown in FIG. 4 include three distinct bridge passageways spaced about the waterjet passage 44 in 120 degree intervals. In other instances, the bridge passageways may be spaced circumferentially about the waterjet passage 44 in an irregular pattern. Moreover, each of the bridge passageways may include a downstream end that is configured to discharge a secondary fluid into the waterjet passage 44 at an angle that is inclined toward the outlet 42 of the waterjet passage 44. In this manner, secondary fluid introduced through the jet alteration passage 50 may impact the jet passing through the waterjet passage 44 at an oblique trajectory.

The downstream portions 52 of the jet alteration passage 50 may be sub-passageways that are configured to simultaneously discharge a secondary fluid from a secondary fluid source 58 (FIGS. 1 and 3) into a path of the waterjet passing through the waterjet passage 44 during operation. Downstream outlets 53 of the sub-passageways may intersect with the waterjet passage 44 such that the outlets 53 collectively define at least a majority of a circumferential section of the waterjet passage 44 which has a height defined by a corresponding height of the outlets 53 intersecting with the waterjet passage 44. In some instances, the downstream outlets 53 of the sub-passageways may intersect with the waterjet passage 44 such that the outlets 53 collectively define at least seventy-five percent of the circumferential section of the waterjet passage 44. Moreover, in some instances, the outlets 53 may overlap or nearly overlap with each other at the intersection with the waterjet passage 44.

The upstream junction 54 of the jet alteration passage 50 may be in fluid communication with a port 56 directly or via an intermediate portion 55. The port 56 may be provided for coupling the jet alteration passage 50 of the nozzle component 20 to the secondary fluid source 58 (FIGS. 1 through 3). With reference to FIG. 1 or 3, the port 56 may be threaded or otherwise configured to receive a fitting, adapter or other connector 57 for coupling the jet alteration passage 50 to the secondary fluid source 58 via a supply conduit 59. Intermediate valves (not shown) or other fluid control devices may be provided to assist in controlling the delivery of a secondary fluid (e.g., water, air) to the jet alteration passage 50 and ultimately into the waterjet passing through the waterjet passage 44. In other instances, the port 56 may be provided for coupling the jet alteration passage 50 to a vacuum source (not shown) for generating a vacuum within the jet alteration passage 50 sufficient to alter flow characteristics of the waterjet passing through the waterjet passage 44. The jet alteration passage 50 may be used intermittently or continuously during a portion of a cutting operation to adjust jet coherence or other jet characteristics. For example, in some instances, a secondary fluid, such as, for example, water or air, may be introduced into the waterjet via the jet alteration passage 50 during a piercing or drilling operation.

Figure 5:
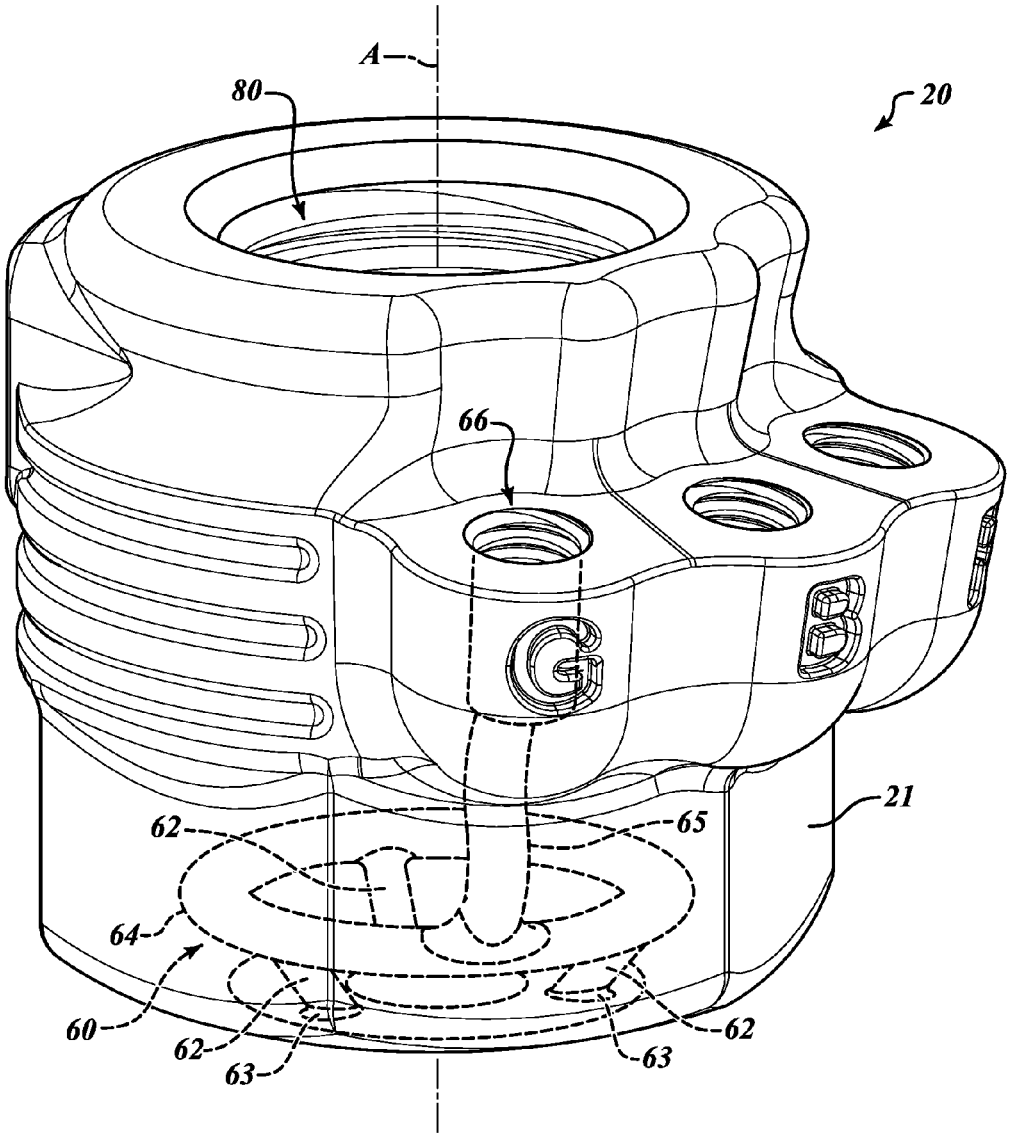
FIG. 5 is an isometric view of the fluid distribution component of FIG. 4 from the same viewpoint, showing other internal passages thereof.

With reference to FIG. 5, an environment control passage 60 may be provided within the nozzle component 20 for discharging a pressurized gas stream to impinge on an exposed surface of a workpiece at or adjacent where the waterjet pierces or cuts through the workpiece during a cutting operation (i.e., the waterjet impingement location). The environment control passage 60 may extend through a body 21 of the nozzle component 20 and include one or more downstream portions 62 that are aligned relative to the waterjet passage 44 (FIGS. 2, 4 and 6) so that gas passed through the environment control passage 60 during operation is directed to impinge on the workpiece at or adjacent the waterjet impingement location. As an example, the environment control passage 60 may include a plurality of distinct downstream portions 62 that are arranged such that respective gas streams discharged from outlets 63 thereof converge in a downstream direction at or near the waterjet impingement location.

With reference to FIG. 3, the gas streams discharged from the outlets 63 of the downstream portions 62 may follow respective trajectories 61 that intersect with a trajectory 23 of the discharged jet. The trajectories 61 of the gas streams may intersect with a trajectory 23 of the discharged jet at an intersection location 24, for example, which is at or near the focal point or standoff distance of the waterjet cutting system 10. In some instances, the intersection location 24 may be slightly short of the focal point or standoff distance. In other instances, the intersection location 24 may be slightly beyond the focal point or standoff distance such that each respective gas stream trajectory 61 intersects with the exposed surface of the workpiece prior to reaching the waterjet impingement location and is then directed by the surface of the workpiece to change direction and flow across the waterjet impingement location.

Although the example environment control passage 60 shown in FIG. 5 shows three distinct downstream portions 62 that converge in a downstream direction, it is appreciated that two, four or more downstream passage portions 62 may be arranged in such a manner.

With reference to FIG. 5, two or more of the downstream portions 62 of the passage 60 may join at an upstream junction 64. The upstream junction 64 may be, for example, a generally annular passage that is in fluid communication with an upstream end of each of the downstream passage portions 62, as shown in FIG. 5. The downstream passage portions 62 of the environment control passage 60 may be distinct sub-passageways that extend between the generally annular passage portion and an external environment of the fluid distribution component 20. The downstream passage portions 62 of the environment control passage 60 may be spaced circumferentially about the waterjet passage 44 in a regular pattern. For example, the downstream passage portions 62 shown in FIG. 5 include three distinct sub-passageways spaced about the waterjet passage 44 in 120 degree intervals. In other instances, the downstream passage portions 62 may be spaced circumferentially about the waterjet passage 44 in an irregular pattern.

In some instances, the downstream passage portions 62 may be configured to simultaneously discharge gas from a common pressurized gas source 68 (FIGS. 1 and 3) to impinge on the workpiece at or adjacent the waterjet impingement location. In this manner, pressurized gas introduced through the environment control passage 60 may impinge or impact on an exposed surface of the workpiece and clear the same of any obstructions (e.g., standing water droplets or particular matter) so that the waterjet may cut through the workpiece in a particularly precise manner.

The upstream junction 64 may be in fluid communication with a port 66 directly or via an intermediate portion 65. The port 66 may be provided for coupling the environment control passage 60 of the nozzle component 20 to a pressurized gas (e.g., air) source 68 (FIGS. 1 and 3). With reference to FIG. 1 or 3, the port 66 may be threaded or otherwise configured to receive a fitting, adapter or other connector 67 for coupling the environmental control passage 60 to the pressurized gas source 68 via a supply conduit 69. Intermediate valves (not shown) or other fluid control devices may be provided to assist in controlling the delivery of pressurized gas to the environment control passage 60 and ultimately to the exposed surface of the workpiece that is to be processed.

Figure 6:
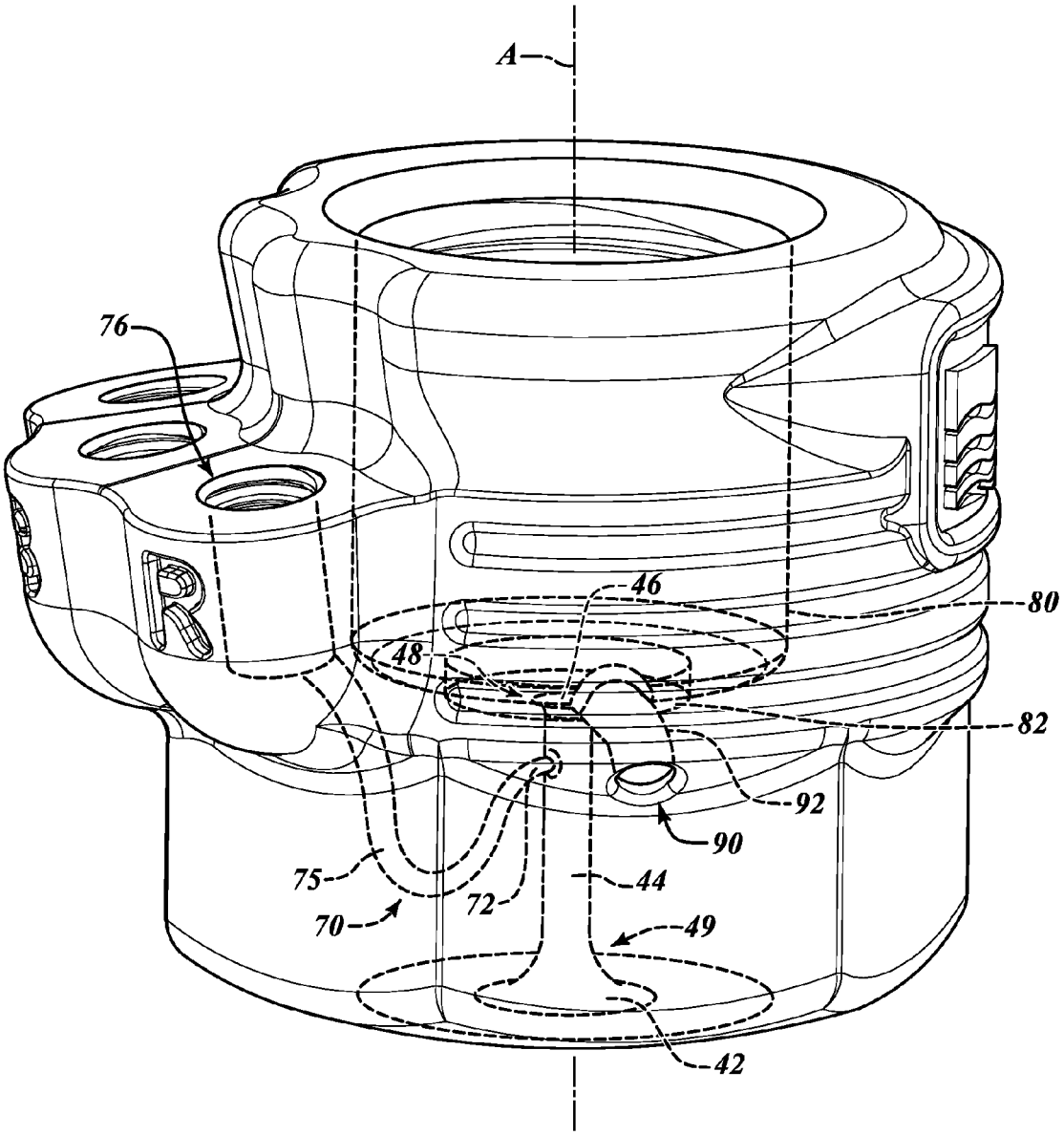
FIG. 6 is an isometric view of the fluid distribution component of FIG. 4 from a different viewpoint, showing other internal passages thereof.

With reference to FIG. 6, a condition detection passage 70 may be provided within the nozzle component 20 to enable detection of a condition of the orifice member 32 (FIG. 2) that is used to generate the waterjet. The condition detection passage 70 may extend through the body 21 of the nozzle component 20 and include one or more downstream portions 72 that intersect with the waterjet passage 44 at an upstream end thereof so that a vacuum level may be sensed that is indicative of a condition of the orifice member 32. As an example, the condition detection passage 70 may include a curvilinear passageway 75 that intersects with the waterjet passage 44 near and downstream of an outlet of the fluid jet passage 36 of the orifice mount 30. The condition detection passage 70 may be in fluid communication with a port 76 that may be provided for coupling the condition detection passage 70 of the nozzle component 20 to a vacuum sensor 78, as shown, for example, in FIGS. 1 and 3. With reference to FIG. 1 or 3, the port 76 may be threaded or otherwise configured to receive a fitting, adapter or other connector 77 for coupling the condition detection passage 70 to the vacuum sensor 78 via a supply conduit 79.

With reference to FIG. 2, the nozzle component 20 may further include a nozzle body cavity 80 for receiving a downstream end of the nozzle body 16 and an orifice mount receiving cavity or recess 82 to receive the orifice mount 30 of the orifice unit 14 when assembled. The orifice mount receiving cavity or recess 82 may be sized to assist in aligning the orifice unit 14 along the axis A of the waterjet passage 44. For instance, orifice mount receiving cavity or recess 82 may comprise a generally cylindrical recess that is sized to insertably receive the orifice mount 30 of the orifice unit 14. The orifice receiving cavity or recess 82 may be formed within a downstream end of the nozzle body cavity 80.

With reference to FIG. 6, the nozzle component 20 may further include a vent passage 92 extending between the nozzle body cavity 80 and an external environment of the nozzle component 20 at vent outlet 90. The vent passage 92 and vent outlet 90 may serve to relieve pressure that may otherwise build within an internal cavity formed around the orifice unit 14 between the nozzle body 16 and the nozzle component 20, as best shown in FIG. 2.

According to the embodiment shown in FIGS. 1 through 6, the nozzle component 20 has a unitary or one-piece body 21 that may be formed from an additive manufacturing or casting process using a material with material property characteristics (e.g., strength) suitable for high-pressure waterjet applications. For instance, in some embodiments, the nozzle component 20 may be formed by a direct metal laser sintering process using 15-5 stainless steel or other steel materials. In addition, the nozzle component 20 may undergo heat treatment or other manufacturing processes to alter the physical properties of the nozzle component 20, such as, for example, increasing the hardness of the nozzle component 20. Although the example nozzle component 20 is shown as having a generally cylindrical body with an array of ports 56, 66, 76 protruding from a side thereof, it is appreciated that in other embodiments, the nozzle component 20 may take on different forms and may have ports 56, 66, 76 located at different positions and with different orientations.

Figure 7:
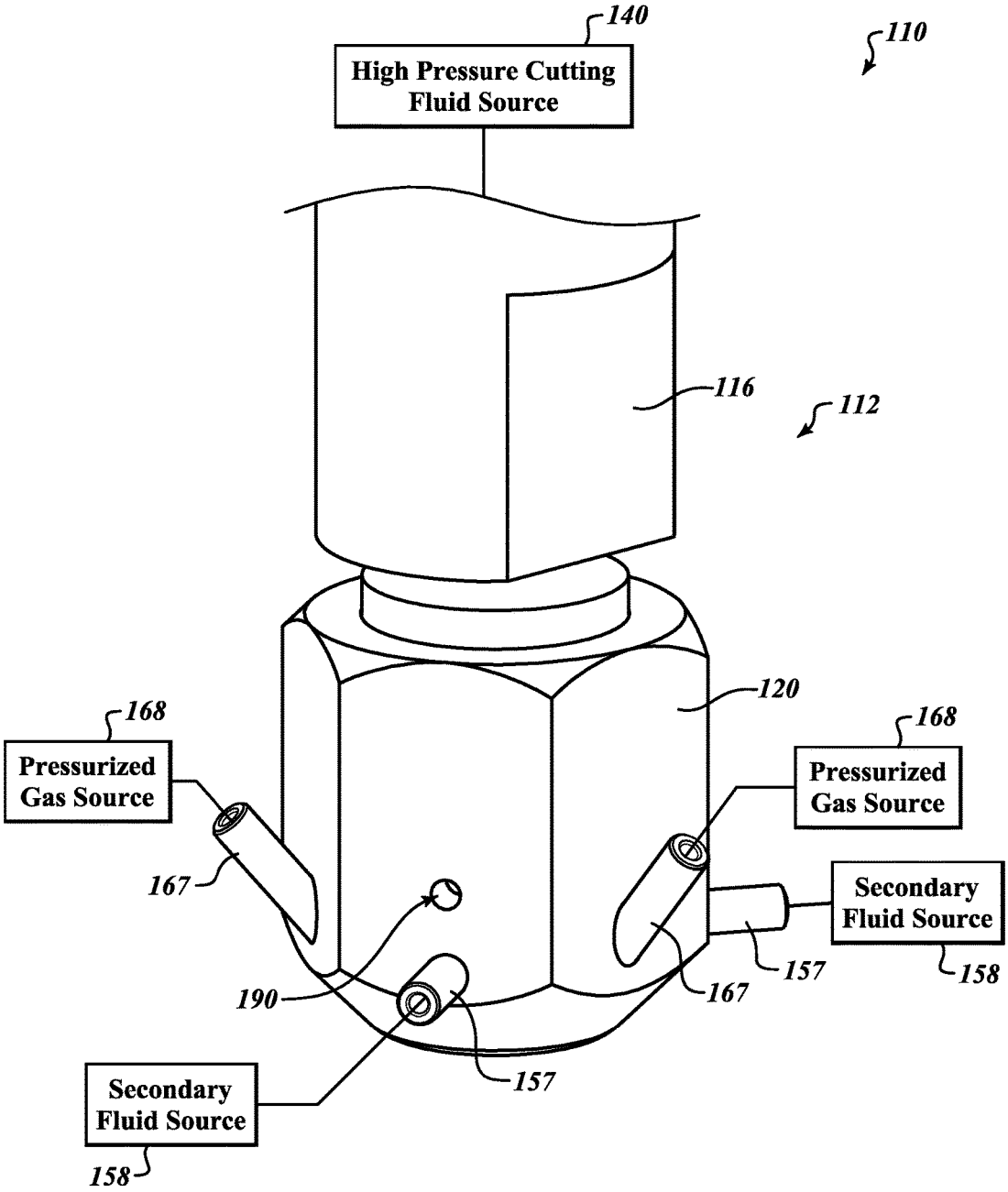
FIG. 7 is an isometric view of a portion of a cutting head assembly of a high-pressure waterjet system, according to another embodiment.
Figure 8:
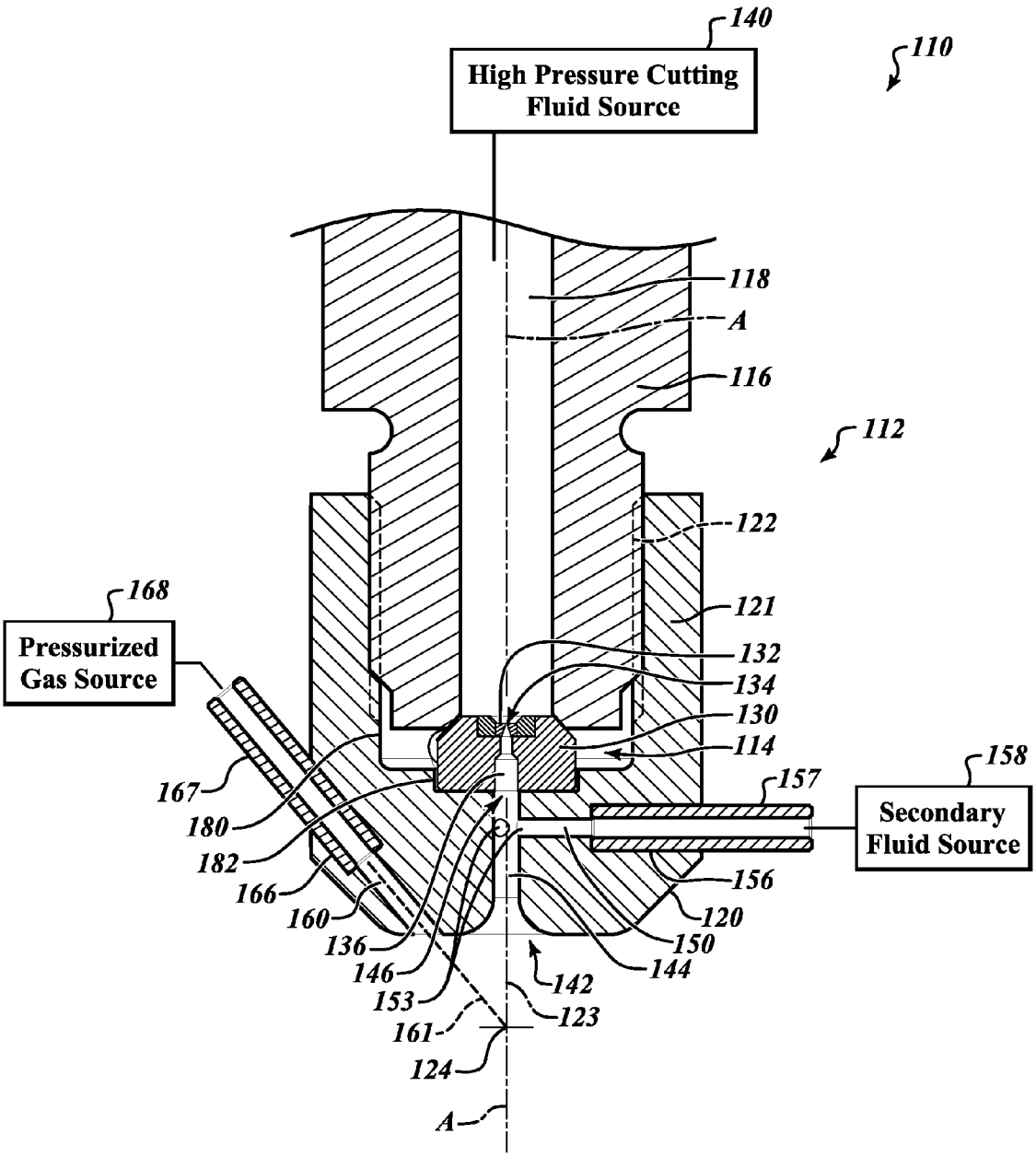
FIG. 8 is a cross-sectional side view of the portion of the cutting head assembly shown in FIG. 7.

Moreover, in some embodiments, a nozzle component 20 may include a unitary or one-piece body formed by other machining or manufacturing processes, such as, for example, subtractive machining processes (e.g., drilling, milling, grinding, etc.). As an example, FIGS. 7 and 8 illustrate an example embodiment of a high-pressure waterjet cutting system 110 having a cutting head assembly 112 with a nozzle component 120 that may be formed by subtractive machining processes (e.g., drilling, milling, grinding, etc.). The cutting head assembly 112 is particularly well adapted for, among other things, cutting workpieces made of composite materials, such as carbon fiber reinforced plastics, with a pure waterjet to meet exacting standards.

With reference to the cross-section of FIG. 8, the cutting head assembly 112 includes an orifice unit 114 through which a cutting fluid (e.g., water) passes during operation to generate a high-pressure fluid jet. The cutting head assembly 112 further includes a nozzle body 116 having a fluid delivery passage 118 extending therethrough to route cutting fluid toward the orifice unit 114. A nozzle component 120 (e.g., nozzle nut) is coupled to the nozzle body 116 with the orifice unit 114 positioned or sandwiched therebetween. The nozzle component 120 may be removably coupled to the nozzle body 116, for example, by a threaded connection 122 or other coupling arrangement. Coupling of the nozzle component 120 to the nozzle body 116 may urge the orifice unit 114 into engagement with the nozzle body 116 to create a seal therebetween.

The nozzle component 120 can have a one-piece construction and can be made, in whole or in part, of one or more metals (e.g., steel, high strength metals, etc.), metal alloys, or the like. The nozzle component 120 may include threads or other coupling features for coupling to other components of cutting head assembly 112.

The orifice unit 114 may include an orifice mount 130 and an orifice member 132 (e.g., jewel orifice) supported thereby for generating a high-pressure fluid jet as high-pressure fluid (e.g., water) passes through an opening 134 in the orifice member 132. A fluid jet passage 136 may be provided in the orifice mount 130 downstream of the orifice member 132 through which the jet passes during operation. The orifice mount 130 is fixed with respect to the nozzle component 120 and includes a recess dimensioned to receive and hold the orifice member 132. The orifice member 132, in some embodiments, is a jewel orifice or other fluid jet or cutting stream producing device used to achieve the desired flow characteristics of the resultant fluid jet. The opening of the orifice member 132 can have a diameter in a range of about 0.001 inch (0.025 mm) to about 0.02 inch (0.5 mm). Openings with other diameters can also be used, if needed or desired.

As shown in FIG. 8, the nozzle body 116 may be coupled to a cutting fluid source 140, such as, for example, a source of high-pressure water (e.g., a direct drive or intensifier pump). During operation, high-pressure fluid (e.g., water) from the cutting fluid source 140 may be controllably fed into the fluid delivery passage 118 of the nozzle body 16 and routed toward the orifice unit 114 to generate the jet (not shown), which is ultimately discharged from the cutting head assembly 112.

With continued reference to FIG. 8, a waterjet passage 144 is shown extending through a body 121 of the nozzle component 120 along longitudinal axis A. The waterjet passage 144 includes an inlet 146 at an upstream end thereof and an outlet 142 at a downstream end thereof through which the waterjet is ultimately discharged during operation.

At least one jet alteration passage 150 may be provided within the nozzle component for adjusting, modifying or otherwise altering the jet that is discharged from the nozzle component 120. The jet alteration passage 150 may extend through the body 121 of the nozzle component 120 and intersect with the waterjet passage 144 between the inlet 146 and the outlet 142 thereof to enable such alteration of the waterjet during operation. More particularly, jet alteration passage 150 may extend through the body 121 of the nozzle component 120 and intersect with the waterjet passage 144 so that a secondary fluid passed through the jet alteration passage 150 during operation may be directed to impact the fluid jet traveling therethrough. As an example, the jet alteration passage 150 may comprise a linear passage that is arranged such that a secondary fluid stream discharged therefrom impacts the fluid jet traveling through the waterjet passage 144. The example embodiment shown in FIGS. 7 and 8 includes three distinct jet alteration passages 150 that are arranged in this manner; however, it is appreciated that one, two, four or more jet alteration passages 150 may be provided.

The jet alteration passages 150 may be spaced circumferentially about the waterjet passage 144 in a regular pattern. For example, the jet alteration passages 150 of the embodiment shown in FIGS. 7 and 8 are spaced about the waterjet passage 144 in 120 degree intervals. In other instances, the jet alteration passages 150 may be spaced circumferentially about the waterjet passage 144 in an irregular pattern. Each of the jet alteration passages 150 may be configured to discharge a secondary fluid into the waterjet passage 144 at a right angle, as shown in FIG. 8, or at an angle that is inclined toward the outlet 142 of the waterjet passage 144. In the latter case, secondary fluid introduced through the jet alteration passages 150 may each impinge or impact on the jet passing through the waterjet passage 144 at an oblique trajectory.

The jet alteration passages 150 may be configured to simultaneously discharge secondary fluid from one or more secondary fluid sources 158 into a path of the waterjet passing through the waterjet passage 144. Downstream outlets 153 of the jet alteration passages 150 may intersect with the waterjet passage 144 such that the outlets 153 collectively define at least a majority of a circumferential section of the waterjet passage 144 that has a height defined by a corresponding height of the outlets 153 intersecting therewith. In some instances, the downstream outlets 153 of the jet alteration passages 150 may intersect with the waterjet passage 144 such that the outlets 153 collectively define at least seventy-five percent of the circumferential section of the waterjet passage 144. In some instances, the outlets 153 may overlap or nearly overlap with each other at the intersection with the waterjet passage 144.

The upstream end of each jet alteration passage 150 may include or define a port 156 for coupling the jet alteration passage 150 of the nozzle component 120 to the one or more secondary fluid sources 158, as shown, for example, in FIGS. 7 and 8. The port 156 may be threaded or otherwise configured to receive a fitting, adapter or other connector 157 for coupling the jet alteration passage 150 to the secondary fluid source 158, such as, for example, via a supply conduit. Intermediate valves (not shown) or other fluid control devices may be provided to assist in controlling the delivery of secondary fluid (e.g., water, air) to the jet alteration passages 150 and ultimately into the fluid jet passing through the waterjet passage 144. In other instances, the port 56 of one or more of the jet alteration passages 150 may be provided for coupling the jet alteration passage 150 to a vacuum source (not shown) for generating a vacuum within the jet alteration passage 150 sufficient to alter flow characteristics of the waterjet passing through the waterjet passage 144. The jet alteration passages 150 may be used intermittently or continuously during a portion of a cutting operation to adjust jet coherence or the like. For example, in some instances, a secondary fluid, such as, for example, water or air, may be introduced into the waterjet via the jet alteration passages 150 during a piercing or drilling operation.

With reference to FIG. 8, one or more environment control passages 160 may be provided within the nozzle component 120 for discharging a pressurized gas stream to impinge on an exposed surface of a workpiece at or adjacent where the waterjet pierces or cuts through the workpiece during a cutting operation (i.e., waterjet impingement location). Each environment control passage 160 may extend through the body 121 of the nozzle component 120 and include a downstream end that is aligned relative to the waterjet passage 144 so that gas passed through the environment control passage 160 during operation is directed to impinge on the workpiece at or adjacent the waterjet impingement location. As an example, the environment control passage 160 may include a linear passage that is directed toward the longitudinal axis A such that a gas stream discharged therefrom follows a trajectory 161 that intersects with a trajectory 123 of the discharged jet. The trajectory 161 of the gas stream may intersect with a trajectory 123 of the discharged jet at an intersection location 124, for example, which is at or near the focal point or standoff distance of the waterjet cutting system 110. In some instances, the intersection location 124 may be slightly short of the focal point or standoff distance. In other instances, the intersection location 124 may be slightly beyond the focal point or standoff distance such that the trajectory of the gas stream intersects with the exposed surface of the workpiece prior to reaching the waterjet impingement location and is then directed by the surface of the workpiece to change direction and flow across the waterjet impingement location.

Although the example embodiment of FIGS. 7 and 8 includes three distinct environment control passages 160 that converge in a downstream direction, it is appreciated that one, two, four or more environment control passages 160 may be arranged in such a manner. In other instances, one or more gas streams may be directed generally collinearly with the discharged jet to form a shroud around the jet.

The environment control passages 160 may be spaced circumferentially about the waterjet passage 144 in a regular pattern. For example, the environment control passages 160 of the embodiment shown in FIGS. 7 and 8 are spaced about the waterjet passage 144 in 120 degree intervals. In other instances, the environment control passages 160 may be spaced circumferentially about the waterjet passage 144 in an irregular pattern. In some instances, the environment control passages 160 may be configured to simultaneously discharge gas from one or more pressurized gas sources 168 to impinge on the workpiece at or adjacent the waterjet impingement location. In this manner, pressurized gas streams discharged from the environment control passages 160 may impinge or impact on an exposed surface of the workpiece and clear the same of obstructions such as standing water droplets or particulate matter so that the waterjet may cut through the workpiece in a particularly precise manner.

The upstream end of each environment control passage 160 may include or define a port 166. The port 166 may be provided for coupling the environment control passage 160 of the nozzle component 120 to the one or more pressurized gas sources 168. The port 166 may be threaded or otherwise configured to receive a fitting, adapter or other connector 167 for coupling the environmental control passage 160 to the one or more pressurized gas sources 168, such as, for example, via one or more supply conduits. Intermediate valves (not shown) or other fluid control devices may be provided to assist in controlling the delivery of pressurized gas to the environment control passages 160 and ultimately to the exposed surface of the workpiece that is to be processed.

With reference to FIGS. 7 and 8, the nozzle component 120 may further include a vent passage extending between a nozzle body cavity 180 and an external environment of the nozzle component 120 at vent outlet 190. The vent passage and vent outlet 190 may serve to relieve pressure that may otherwise build within an internal cavity formed around the orifice unit 114 between the nozzle body 116 and the nozzle component 120, as best shown in FIG. 8.

During operation, and with reference to FIGS. 7 and 8, high-pressure water may be selectively supplied from the high-pressure water source 140 to the nozzle body 116. The high-pressure water may travel through the passage 118 in the nozzle body 116 toward the orifice member 132 supported in the orifice mount 130 of the orifice unit 114, which is compressed between the nozzle body 116 and an orifice mount receiving cavity 182 of the nozzle component 120. As the high-pressure water passes through the orifice member 132, a fluid jet is generated and discharged downstream through the fluid jet passage 136 in the orifice mount 130. The jet continues through the waterjet passage 144 of the nozzle component 120 and is ultimately discharged through the outlet 142 of the nozzle component 120 onto a workpiece or work surface to be cut or processed in a desired manner.

As can be appreciated from descriptions above, additional features and functionality may be provided along the flow path of the waterjet to condition or otherwise alter the jet prior to discharge. For example, one or more jet alteration passages 160 may be provided and coupled to one or more secondary fluid sources 158, vacuum sources or other devices to alter the jet as it passes through the waterjet passage 144 of the nozzle component 120. In addition, one or more gas streams may be discharged from one or more environment control passages 160 and directed to clear an area on an exposed surface of the workpiece from obstructions, such as standing water droplets and/or particulate matter.

Although the example cutting head assemblies 12, 112 of FIGS. 1 through 8 are shown particularly as systems for generating a pure water jet unladen with abrasives, it is appreciated that in other embodiments, an abrasive media source may be coupled to the cutting head assemblies 12, 112 to deliver abrasive media into the fluid jet via a mixing chamber, for example, such that the waterjet mixes with the abrasive media to form an abrasive waterjet. In addition, the nozzle components 20, 120 described herein may include a cavity or other feature for receiving an elongated mixing tube element which may project from the end of the nozzle components 20, 120 and provide an extended passage within which the abrasive media may mix thoroughly with the waterjet prior to discharge from the cutting head assemblies 12, 112.

FIGS. 9 through 12 show one example of a portion of a fluid jet cutting system 210 that includes a cutting head assembly 212 that is particularly well suited for cutting workpieces with an abrasive waterjet, and alternatively, with a pure waterjet.

Figure 10:
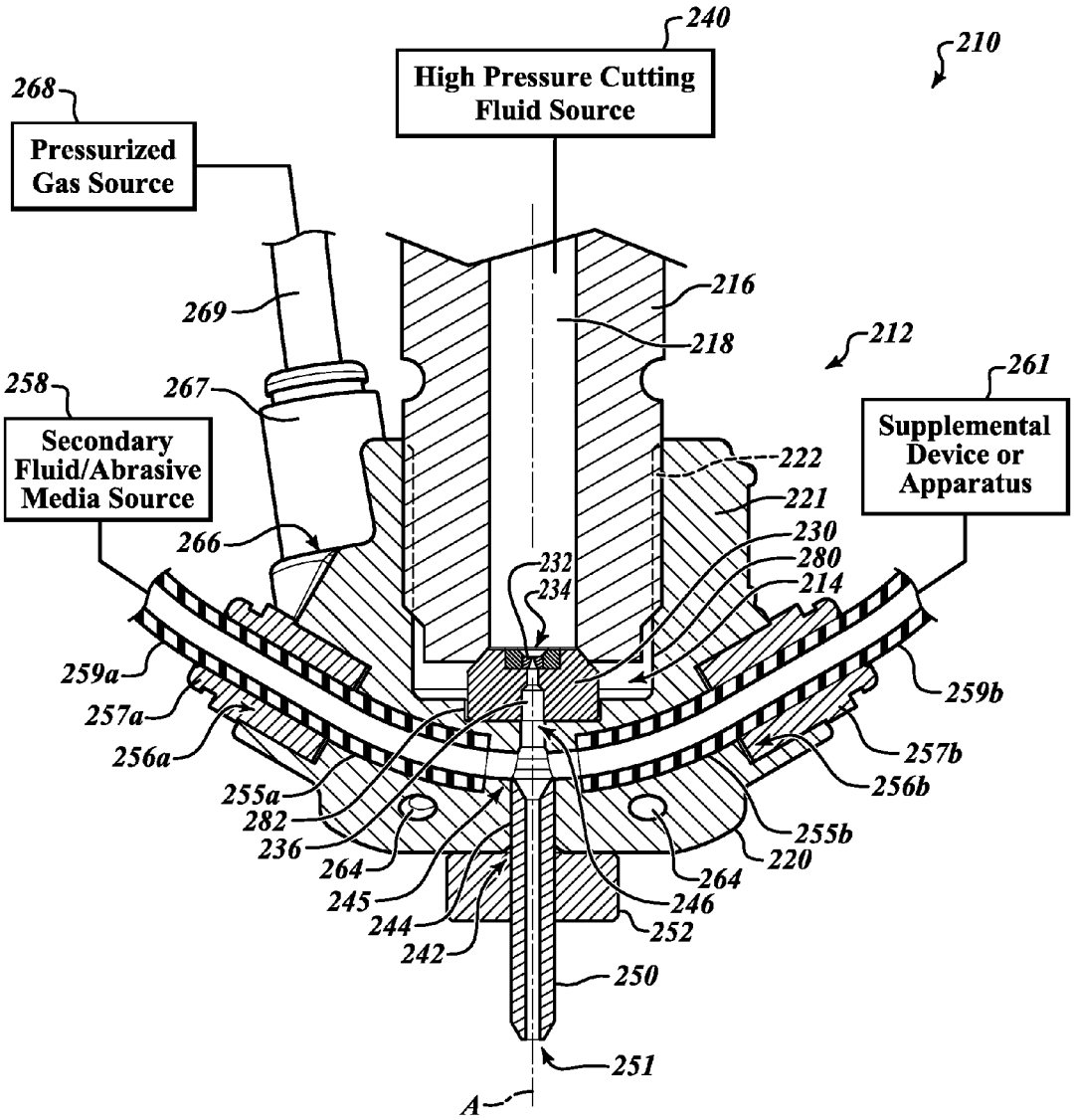
FIG. 10 is a cross-sectional side view of the portion of the cutting head assembly shown in FIG. 9.

With reference to the cross-section shown in FIG. 10, the cutting head assembly 212 includes an orifice unit 214 through which a cutting fluid (e.g., water) passes during operation to generate a high-pressure fluid jet. The cutting head assembly 212 further includes a nozzle body 216 having a fluid delivery passage 218 extending therethrough to route cutting fluid toward the orifice unit 214. A nozzle component 220 is coupled to the nozzle body 216 with the orifice unit 214 positioned or sandwiched therebetween. The nozzle component 220 may be removably coupled to the nozzle body 216, for example, by a threaded connection 222 or other coupling arrangement. Coupling of the nozzle component 220 to the nozzle body 216 may urge the orifice unit 214 into engagement with the nozzle body 216 to create a seal therebetween.

The nozzle component 220 can have a one-piece construction and can be made, in whole or in part, of one or more metals (e.g., steel, high strength metals, etc.), metal alloys, or the like. The nozzle component 220 may include threads or other coupling features for coupling to other components of cutting head assembly 212.

The orifice unit 214 may include an orifice mount 230 and an orifice member 232 (e.g., jewel orifice) supported thereby for generating a high-pressure fluid jet as high-pressure fluid (e.g., water) passes through an opening 234 in the orifice member 232. A fluid jet passage 236 may be provided in the orifice mount 230 downstream of the orifice member 232 through which the jet passes during operation. The orifice mount 230 is fixed with respect to the nozzle component 220 and includes a recess dimensioned to receive and hold the orifice member 232. The orifice member 232, in some embodiments, is a jewel orifice or other fluid jet or cutting stream producing device used to achieve the desired flow characteristics of the resultant fluid jet. The opening of the orifice member 232 can have a diameter in a range of about 0.001 inch (0.025 mm) to about 0.02 inch (0.5 mm). Openings with other diameters can also be used, if needed or desired.

As shown in FIG. 10, the nozzle body 216 may be coupled to a high-pressure cutting fluid source 240, such as, for example, a source of high-pressure water (e.g., a direct drive or intensifier pump). During operation, high-pressure fluid (e.g., water) from the cutting fluid source 240 may be controllably fed into the fluid delivery passage 218 of the nozzle body 216 and routed toward the orifice unit 214 to generate the jet (not shown), which is ultimately discharged from the cutting head assembly 212 after passing through a waterjet passage 244 that extends through a body 221 of the nozzle component 220 along longitudinal axis A between an inlet 246 at an upstream end thereof and the outlet 242 at a downstream end thereof.

An elongated nozzle or mixing tube 250 may be provided downstream of the orifice unit 214 to receive the high-pressure waterjet and discharge the waterjet toward a workpiece or work surface via an outlet 251 at the terminal end thereof. The elongated nozzle or mixing tube 250 may be removably coupled to the nozzle component to enable the system 210 to transition between a pure waterjet cutting configuration, in which the elongated nozzle or mixing tube 250 is not present, and an abrasive waterjet cutting configuration, in which the elongated nozzle or mixing tube 250 is present.

As an example, the elongated nozzle or mixing tube 250 may include a magnetic collar 252 that is configured to secure the elongated nozzle or mixing tube 250 in position via magnetic coupling between the collar 252 and the nozzle component 220. In other instances, the elongated nozzle or mixing tube 250 may be coupled to the nozzle component 220 by one or more fastener devices or fastening techniques, including for example, those shown and described in Flow's U.S. patent application Ser. No. 12/154,313, which is hereby incorporated by reference in its entirety. Advantageously, the elongated nozzle or mixing tube 250 may be provided to process certain materials that may not be readily processed with a pure waterjet. Conversely, the elongated nozzle or mixing tube 250 may be omitted to process certain materials that can be readily processed with a pure waterjet. Advantageously, the system 210 can be easily converted between the pure waterjet cutting configuration and the abrasive waterjet cutting configuration as needed or desired.

With reference to FIG. 10, at least one jet alteration passage 255*a*, 255*b* may be provided through or within the nozzle component 220 for adjusting, modifying or otherwise altering the jet that is discharged from the cutting head assembly 212. Each jet alteration passage 255*a*, 255*b* may extend through the body 221 of the nozzle component 220 and intersect with the waterjet passage 244 between the inlet 246 and the outlet 242 thereof to enable such alteration or modification of the waterjet during operation.

According to the embodiment shown in FIGS. 9 through 12, a first jet alteration passage 255*a* extends through the body 221 of the nozzle component 220 to provide fluid communication between a secondary fluid or abrasive media source 258 and the waterjet passage 244. A downstream end of the jet alteration passage 255*a* intersects with the waterjet passage 244 so that a secondary fluid or abrasive media passed through the jet alteration passage 255*a* during operation may be directed to impact and/or mix with the waterjet traveling therethrough. As an example, the jet alteration passage 255*a* may include a single curvilinear passage that is arranged such that abrasive media is directed from an upstream location exterior to the nozzle component 220 toward a mixing chamber 245 defined by the intersection of the jet alteration passage 255*a* and the waterjet passage 244.

Figure 9:
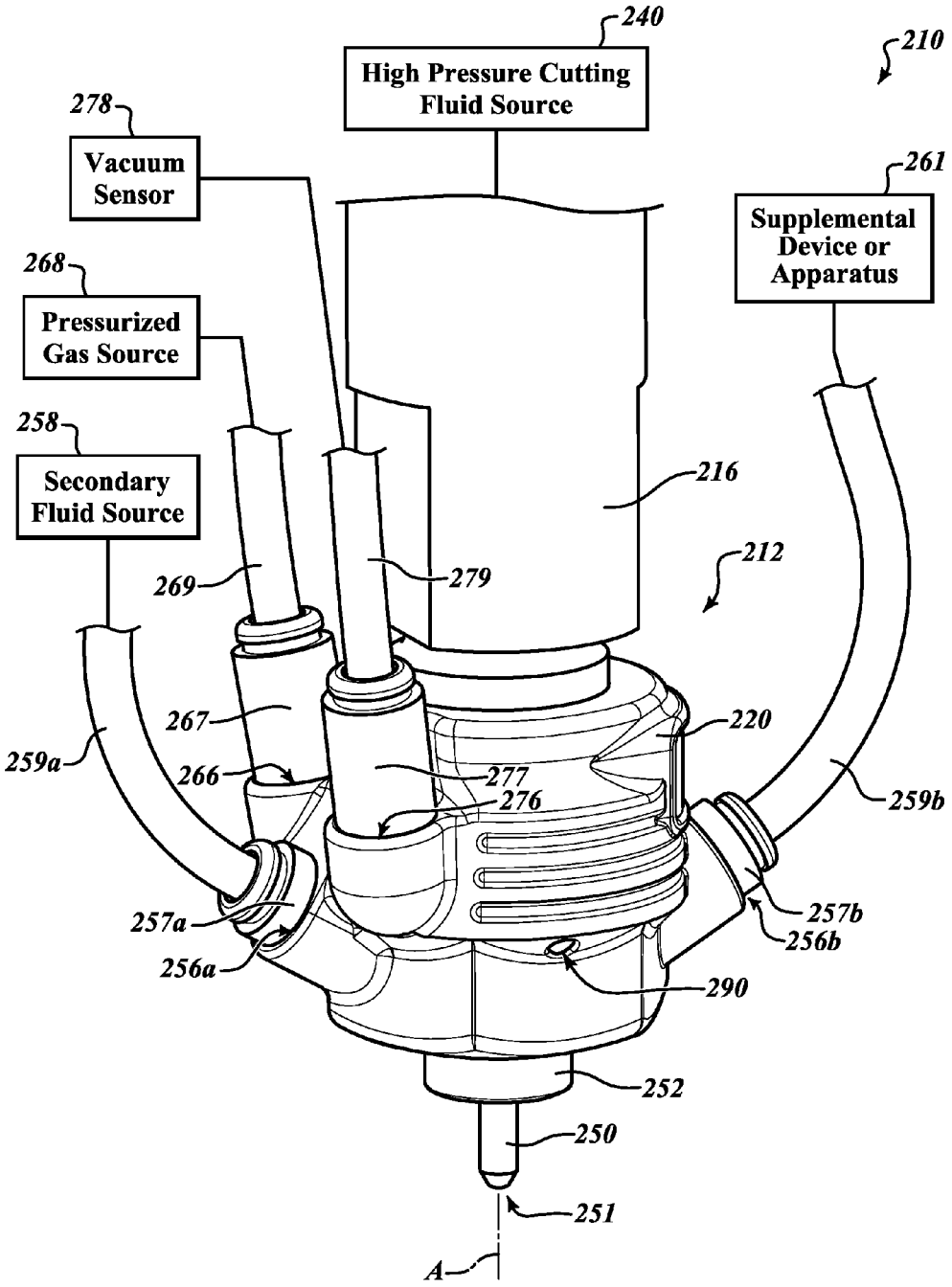
FIG. 9 is an isometric view of a portion of a cutting head assembly of a high-pressure waterjet system, according to yet another embodiment.

The upstream end of the jet alteration passage 255*a* may be in fluid communication with a port 256*a*. The port 256*a* may be provided for coupling the jet alteration passage 255*a* of the nozzle component 220 to the secondary fluid or abrasive media source 258. With reference to FIG. 9 or 10, the port 256*a* may be threaded or otherwise configured to receive a fitting, adapter or other connector 257*a* for coupling the jet alteration passage 255*a* to the secondary fluid or abrasive media source 258 via a supply conduit 259*a*. Intermediate valves (not shown) or other fluid control devices may be provided to assist in controlling the delivery of a secondary fluid (e.g., water, air) or abrasive media to the jet alteration passage 255*a* and ultimately into the waterjet passing through the waterjet passage 244.

According to the embodiment shown in FIGS. 9 through 12, a second jet alteration passage 255*b* extends through the body 221 of the nozzle component 220 to provide fluid communication between a supplemental device or apparatus 261, such as, for example, a secondary fluid source, an abrasive source or a vacuum device, and the waterjet passage 244. A downstream end of the jet alteration passage 255*b* intersects with the waterjet passage 244 so that a secondary fluid or abrasive media may be passed through the jet alteration passage 255*b* during operation and may be directed to impact and/or mix with the waterjet traveling therethrough, or so that a vacuum can be applied to assist in drawing abrasive media into the waterjet via the aforementioned jet alteration passage 255*a*, as discussed above. The second jet alteration passage 255*b* may include a single curvilinear passage that is arranged opposite the first jet alteration passage 255*a* and may have the same or a similar path or trajectory.

The upstream end of the second jet alteration passage 255*b* may be in fluid communication with a port 256*b*. The port 256*b* may be provided for coupling the jet alteration passage 255*b* of the nozzle component 220 to the supplemental device or apparatus 261. With reference to FIG. 9, the port 256*b* may be threaded or otherwise configured to receive a fitting, adapter or other connector 257*b* for coupling the jet alteration passage 255*b* to the supplemental device or apparatus 261 via a supply conduit 259*b*. Intermediate valves (not shown) or other fluid control devices may be provided to assist in controlling the delivery of a secondary fluid (e.g., water, air) or abrasive media to the jet alteration passage 255*b* and ultimately into the waterjet passing through the waterjet passage 244. In other instances, intermediate valves or other fluid control devices may be provided to assist in creating a vacuum within the passage 255*b* to assist in drawing abrasive media into the waterjet or otherwise adjusting or altering the coherence or flow characteristics of the waterjet passing through the waterjet passage 244.

The jet alteration passages 255*a*, 255*b* may be used intermittently or continuously during a portion of a cutting operation to adjust jet coherence or other jet characteristics. For example, in some instances, a secondary fluid, such as, for example, water or air or other gas, may be introduced into the waterjet via one or more of the jet alteration passages 255*a*, 255*b* during a piercing or drilling operation. In other instances, abrasive media may be fed or drawn into the waterjet via one or more of the jet alteration passages 255*a*, 255*b* when operating in an abrasive waterjet cutting configuration. In some instances, one of the jet alteration passages 255*a* may route abrasive media into the waterjet while another jet alteration passage 255*b* is coupled to a supplemental apparatus 261 in the form of a vacuum source 261 to assist in drawing abrasive media into the waterjet.

Further details of internal passages of the nozzle component 220, including the waterjet passage 244, are shown and described with reference to FIGS. 11 and 12.

Figure 11:
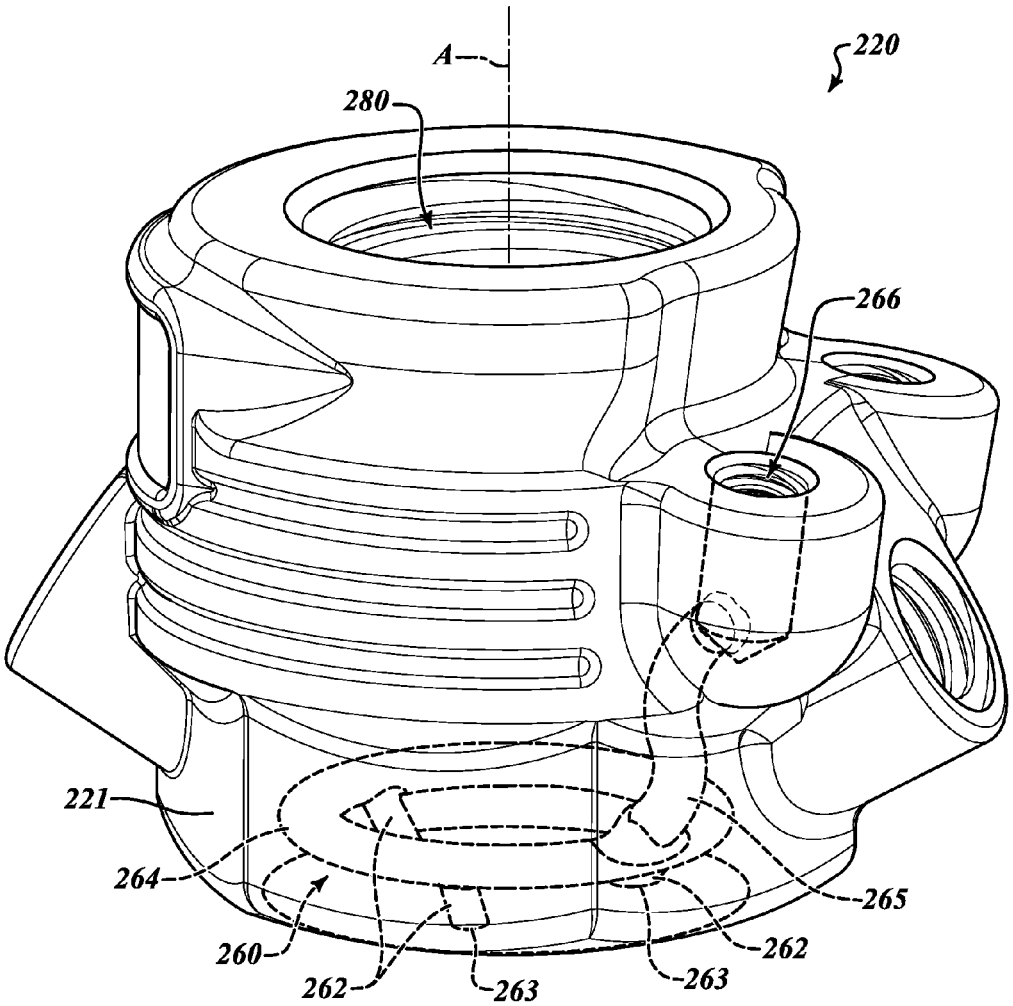
FIG. 11 is an isometric view of a fluid distribution component of the cutting head assembly shown in FIG. 9, showing one of several internal passages thereof.

With reference to FIG. 11, an environment control passage 260 may be provided within the nozzle component 220 for discharging a pressurized gas stream to impinge on an exposed surface of a workpiece at or adjacent where the waterjet pierces or cuts through the workpiece during a cutting operation (i.e., the waterjet impingement location). The environment control passage 260 may extend through a body 221 of the nozzle component 220 and include one or more downstream portions 262 that are aligned relative to the waterjet passage 244 (FIGS. 10 and 12) so that gas passed through the environment control passage 260 during operation is directed to impinge on the workpiece at or adjacent the waterjet impingement location. As an example, the environment control passage 260 may include a plurality of distinct downstream portions 262 that are arranged such that respective gas streams discharged from outlets 263 thereof converge in a downstream direction at or near the waterjet impingement location.

The gas streams discharged from the outlets 63 of the downstream portions 62 may follow respective trajectories that intersect with a trajectory of the discharged jet. The trajectories of the gas streams may intersect with a trajectory of the discharged jet at an intersection location, for example, which is at or near the focal point or standoff distance of the waterjet cutting system 210. In some instances, the intersection location may be slightly short of the focal point or standoff distance. In other instances, the intersection location may be slightly beyond the focal point or standoff distance such that each respective gas stream trajectory intersects with the exposed surface of the workpiece prior to reaching the waterjet impingement location and is then directed by the surface of the workpiece to change direction and flow across the waterjet impingement location.

Although the example environment control passage 260 shown in FIG. 11 shows three distinct downstream portions 262 that converge in a downstream direction, it is appreciated that two, four or more downstream passage portions 262 may be arranged in such a manner.

With reference to FIG. 11, two or more of the downstream portions 262 of the passage 260 may join at an upstream junction 264. The upstream junction 264 may be, for example, a generally annular passage that is in fluid communication with an upstream end of each of the downstream passage portions 262. The downstream passage portions 262 of the environment control passage 260 may be distinct sub-passageways that extend between the generally annular passage portion and an external environment of the fluid distribution component 220. The downstream passage portions 262 of the environment control passage 260 may be spaced circumferentially about the waterjet passage 244 in a regular pattern. For example, the downstream passage portions 262 shown in FIG. 11 include three distinct sub-passageways spaced about the waterjet passage 244 in 120 degree intervals. In other instances, the downstream passage portions 262 may be spaced circumferentially about the waterjet passage 244 in an irregular pattern.

In some instances, the downstream passage portions 262 may be configured to simultaneously discharge gas from a common pressurized gas source 268 (FIGS. 9 and 10) to impinge on the workpiece at or adjacent the waterjet impingement location. In this manner, pressurized gas introduced through the environment control passage 260 may impinge or impact on an exposed surface of the workpiece and clear the same of any obstructions (e.g., standing water droplets or particular matter) so that the waterjet may cut through the workpiece in a particularly precise manner.

The upstream junction 264 may be in fluid communication with a port 266 directly or via an intermediate portion 265. The port 266 may be provided for coupling the environment control passage 260 of the nozzle component 220 to a pressurized gas source 268 (FIGS. 9 and 10). With reference to FIG. 9 or 10, the port 266 may be threaded or otherwise configured to receive a fitting, adapter or other connector 267 for coupling the environmental control passage 260 to the pressurized gas source 268 via a supply conduit 269. Intermediate valves (not shown) or other fluid control devices may be provided to assist in controlling the delivery of pressurized gas to the environment control passage 260 and ultimately to the exposed surface of the workpiece that is to be processed. In other instances, the environment control passage 260 may be connected to a different fluid source, such as, for example, a pressurized liquid source.

Figure 12:
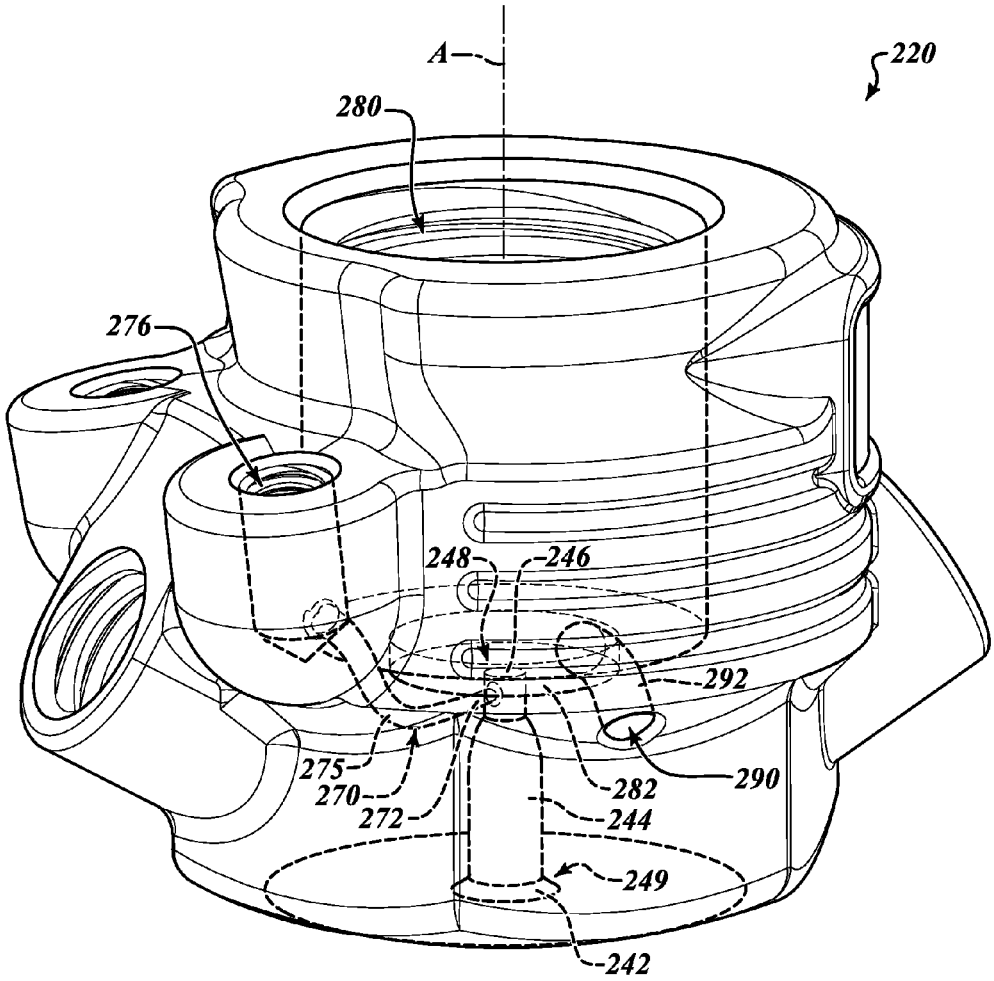
FIG. 12 is an isometric view of the fluid distribution component of FIG. 11 from a different viewpoint, showing other internal passages thereof.

With reference to FIG. 12, a condition detection passage 270 may be provided within the nozzle component 220 to enable detection of a condition of the orifice member 232 (FIG. 10) that is used to generate the waterjet. The condition detection passage 270 may extend through the body 221 of the nozzle component 220 and include one or more downstream portions 272 that intersect with the waterjet passage 244 at an upstream end thereof so that a vacuum level may be sensed that is indicative of a condition of the orifice member 232. As an example, the condition detection passage 270 may include a curvilinear passageway 275 that intersects with the waterjet passage 244 near and downstream of an outlet of the fluid jet passage 236 of the orifice mount 230. The condition detection passage 270 may be in fluid communication with a port 276 that may be provided for coupling the condition detection passage 270 of the nozzle component 220 to a vacuum sensor 278, as shown, for example, in FIG. 9. With reference to FIG. 9, the port 276 may be threaded or otherwise configured to receive a fitting, adapter or other connector 277 for coupling the condition detection passage 270 to the vacuum sensor 278 via a supply conduit 279.

With reference to FIG. 10, the nozzle component 220 may further include a nozzle body cavity 280 for receiving a downstream end of the nozzle body 216 and an orifice mount receiving cavity or recess 282 to receive the orifice mount 230 of the orifice unit 214 when assembled. The orifice mount receiving cavity or recess 282 may be sized to assist in aligning the orifice unit 214 along the axis A of the waterjet passage 244. For instance, orifice mount receiving cavity or recess 282 may comprise a generally cylindrical recess that is sized to insertably receive the orifice mount 230 of the orifice unit 214. The orifice receiving cavity or recess 282 may be formed within a downstream end of the nozzle body cavity 280.

With reference to FIG. 12, the nozzle component 220 may further include a vent passage 292 extending between the nozzle body cavity 280 and an external environment of the nozzle component 220 at vent outlet 290. The vent passage 292 and vent outlet 290 may serve to relieve pressure that may otherwise build within an internal cavity formed around the orifice unit 214 between the nozzle body 216 and the nozzle component 220, as best shown in FIG. 10.

According to the embodiment shown in FIGS. 9 through 12, the nozzle component 220 has a unitary or one-piece body 221 that may be formed from an additive manufacturing or casting process using a material with material property characteristics (e.g., strength) suitable for high-pressure waterjet applications. For instance, in some embodiments, the nozzle component 220 may be formed by a direct metal laser sintering process using 15-5 stainless steel or other steel materials. In addition, the nozzle component 220 may undergo heat treatment or other manufacturing processes to alter the physical properties of the nozzle component 220, such as, for example, increasing the hardness of the nozzle component 220. Although the example nozzle component 220 is shown as having a generally cylindrical body with an array of ports 256*a*, 256*b*, 266, 276 protruding from a side thereof, it is appreciated that in other embodiments, the nozzle component 220 may take on different forms and may have ports 256*a*, 256*b*, 266, 276 located at different positions and with different orientations.

Although abrasive waterjet systems and components are contemplated (e.g., fluid jet cutting system 210 shown in FIG. 9), many of the systems, components and methods described herein are particularly well adapted for processing certain workpieces, such as, for example, composite workpieces, with a pure waterjet that is unladen with abrasives. As used herein, the term pure waterjet does not exclude the inclusion of conditioners or other additives, but refers to waterjets that lack abrasive media particles, such as garnet particles. The systems, components and methods described herein can enable cutting of workpieces made of composite materials, such as carbon fiber reinforced plastics, without the additional complexities associated with providing abrasive waterjet functionality, but while maintaining cut quality and precision that is on par with such abrasive systems. Advantageously, the environment control passages and related functionality described herein enable an exposed workpiece surface to be cleared of obstructions, such as standing water droplets or particulate matter, which might otherwise impede the path of the discharged waterjet and retard its ability to cut cleanly and efficiently through a workpiece, such as a composite workpiece.

In view of the above, it will be appreciated that a wide variety of nozzle components 20, 120, 220 for high-pressure waterjet systems 10, 110, 210 may be provided in accordance with various aspects described herein, which are particularly well adapted for receiving a high-pressure waterjet, a flow of secondary fluid and/or a flow of pressurized gas to enable jet coherence adjustment and/or control of a cutting environment while discharging the jet towards an exposed surface of a workpiece. The nozzle components 20, 120, 220 may include complex passages (e.g., passages with curvilinear trajectories and/or varying cross-sectional shapes and/or sizes) that are well suited for routing fluid or other matter in particularly efficient and reliable form factors. Benefits of embodiments of such nozzle components 20, 120, 220 include the ability to provide enhanced flow characteristics and/or to reduce turbulence within the internal passages. This can be particularly advantageous when space constraints might not otherwise provide sufficient space for developing favorable flow characteristics. For example, a low profile nozzle component 20, 120, 220 may be desired when cutting workpieces within confined spaces. Including nozzle components 20, 120, 220 with internal passages as described herein can enable such low profile nozzle components 20, 120, 220 to generate a fluid jet with desired jet characteristics despite such space constraints. In addition, the fatigue life of such nozzle components 20, 120, 220 may be extended by eliminating sharp corners, abrupt transitions and other stress concentrating features. These and other benefits may be provided by the various embodiments described herein.

In accordance with the various waterjet cutting systems 10, 110, 210 cutting head assemblies 12, 112, 212 and nozzle components 20, 120, 220 described herein, related methods of cutting a workpiece may also be provided. One example method includes directing a waterjet onto a surface of a workpiece that is exposed to the surrounding atmosphere and simultaneously directing a gas stream onto the exposed surface of the workpiece at or adjacent a cutting location to maintain a cutting environment at the cutting location that is, apart from the waterjet, substantially devoid of fluid or particulate matter. The method may further include moving a source of the waterjet relative to the workpiece to cut the workpiece along a desired path while continuously directing the gas stream onto the exposed surface of the workpiece at or adjacent the cutting location. In this manner, a cutting environment may be established and maintained throughout a cut which is unobstructed or substantially unobstructed of standing fluid or particulate matter, for example, which can enable cutting of workpieces in a more precise manner. In some instances, the cutting of composite workpieces with a pure waterjet with high precision may be enabled. Advantageously, the use of abrasive media, such as garnet, may be avoided in some instances, which can simplify the cutting process and provide a cleaner work environment. In other instances, the method may further include cutting workpieces with an abrasive waterjet during at least a portion of a processing operation. In some instances, a workpiece processing operation may be performed in which a waterjet is unladened with abrasives and a second workpiece processing operation may be performed with abrasives in close succession after attaching a mixing tube to a source of the waterjet.

The method may further include introducing a secondary fluid (e.g., water, air) into the waterjet to alter the waterjet during at least a portion of a cutting operation. In this manner, coherence or other properties or characteristics of the discharged jet can be selectively altered. In some instances, for example, the jet may be altered during drilling, piercing or other procedures wherein it may be beneficial to reduce the energy of the waterjet prior to impingement on a workpiece or work surface. This can reduce delamination and other defects when cutting composite materials such as carbon fiber reinforced plastics.

Additional features and other aspects that may augment or supplement the methods described herein will be appreciated from a detailed review of the present disclosure.

Moreover, aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A nozzle component of a high-pressure waterjet cutting system that includes an end effector assembly configured to receive high-pressure water and generate a high-pressure waterjet for processing a workpiece, the nozzle component comprising:

a unitary, one-piece body having:

a waterjet passage extending through the unitary, one-piece body along an axis, the waterjet passage including an inlet at an upstream end thereof and an outlet at a downstream end thereof;

at least one jet alteration passage extending through the unitary, one-piece body and intersecting with the waterjet passage between the inlet and the outlet thereof to enable selective alteration of the waterjet during operation as the waterjet travels through the waterjet passage and is discharged through the outlet, the jet alteration passage including a generally annular portion that encircles the waterjet passage and a plurality of bridge passageways each extending between the generally annular portion and the waterjet passage; and at least one environment control passage extending through the unitary, one-piece body and having at least a downstream portion aligned relative to the fluid jet passage so that gas passed through the environment control passage during operation is directed to impinge on the workpiece at or adjacent a waterjet impingement location.

2. The nozzle component of claim 1 wherein the unitary, one-piece body further includes a condition detection passage extending through the unitary, one-piece body and intersecting with the waterjet passage between the inlet and the outlet thereof to enable detection of a condition of an upstream component that generates the waterjet.

3. The nozzle component of claim 1 wherein the unitary, one-piece body is formed from an additive manufacturing or casting process.

4. The nozzle component of claim 1 wherein the unitary, one-piece body further includes a first port in fluid communication with the jet alteration passage for coupling the jet alteration port to a secondary fluid source and a second port in fluid communication with the environment control passage for coupling the environment control passage to a pressurized gas source.

5. The nozzle component of claim 1 wherein the plurality of bridge passageways are spaced circumferentially about the waterjet passage in a regular pattern.

6. The nozzle component of claim 1 wherein each of the bridge passageways includes a downstream end configured to discharge a secondary fluid into the waterjet passage at an angle that is inclined toward the outlet of the waterjet passage.

7. The nozzle component of claim 1 wherein the jet alteration passage includes a plurality of distinct sub-passageways that are configured to simultaneously discharge a secondary fluid from a common secondary fluid source into a path of the waterjet passing through the waterjet passage during operation.

8. The nozzle component of claim 1 wherein the environment control passage includes a generally annular portion that encircles the waterjet passage.

9. The nozzle component of claim 8 wherein the environment control passage includes a plurality of distinct sub-passageways each extending between the generally annular portion and an external environment of the nozzle component.

10. The nozzle component of claim 9 wherein the plurality of distinct sub-passageways of the environment control passage are spaced circumferentially about the waterjet passage in a regular pattern.

11. The nozzle component of claim 9 wherein each of the distinct sub-passageways of the environment control passage includes a downstream end configured to discharge gas to impinge on the workpiece at or adjacent the waterjet impingement location.

12. The nozzle component of claim 1 wherein the environment control passage includes a plurality of distinct sub-passageways that are configured to simultaneously discharge gas from a common pressurized gas source to impinge on the workpiece at or adjacent the waterjet impingement location during operation.

13. The nozzle component of claim 1 wherein the unitary, one-piece body further includes an orifice mount receiving cavity and a vent passage extending between the orifice mount receiving cavity and an external environment of the nozzle component.

14. A nozzle component of a high-pressure waterjet cutting system that includes an end effector assembly configured to receive high-pressure water and generate a high-pressure waterjet for processing a workpiece, the nozzle component comprising:

a unitary body having:

a waterjet passage extending through the unitary body along an axis, the waterjet passage including an inlet at an upstream end thereof and an outlet at a downstream end thereof; and at least one jet alteration passage extending through the unitary body and intersecting with the waterjet passage between the inlet and the outlet thereof to enable selective alteration of the waterjet during operation as the waterjet travels through the waterjet passage and is discharged through the outlet, the jet alteration passage including a generally annular portion that encircles the waterjet passage and a plurality of bridge passageways each extending between the generally annular portion and the waterjet passage.

15. The nozzle component of claim 14 wherein each of the bridge passageways includes a downstream end configured to discharge a secondary fluid into the waterjet passage at an angle that is inclined toward the outlet of the waterjet passage.

16. A cutting head assembly of a high-pressure waterjet cutting system, the cutting head assembly comprising:

an orifice unit through which water passes during operation to generate a high-pressure waterjet for cutting a workpiece;

a nozzle body including a fluid delivery passage to route water toward the orifice unit; and a nozzle component having a unitary, one-piece body and being coupled to the nozzle body with the orifice unit positioned therebetween, the nozzle component including:

a waterjet passage extending through the unitary, one-piece body along an axis, the waterjet passage including an inlet at an upstream end thereof and an outlet at a downstream end thereof;

at least one jet alteration passage extending through the unitary, one-piece body and intersecting with the waterjet passage between the inlet and the outlet thereof to enable selective alteration of the waterjet during operation as the waterjet travels through the waterjet passage and is discharged through the outlet, the jet alteration passage including a generally annular portion that encircles the waterjet passage and a plurality of bridge passageways each extending between the generally annular portion and the waterjet passage; and at least one environment control passage extending through the unitary, one-piece body and having at least a downstream portion aligned relative to the fluid jet passage so that gas passed through the environment control passage during operation is directed to impinge on the workpiece at or adjacent a waterjet impingement location.

17. The cutting head assembly of claim 16 wherein the nozzle component further includes a condition detection passage extending therethrough and intersecting with the waterjet passage between the inlet and the outlet thereof to enable detection of a condition of the orifice unit.

18. The cutting head assembly of claim 16 wherein the nozzle component is formed from an additive manufacturing or casting process.

19. The cutting head assembly of claim 16 wherein each bridge passageway of the jet alteration passage of the nozzle component includes a downstream end configured to discharge a secondary fluid into the waterjet passage of the nozzle component at an angle that is inclined toward the outlet of the waterjet passage.

20. The cutting head assembly of claim 16 wherein the plurality of bridge passageways are configured to simultaneously discharge a secondary fluid from a common secondary fluid source into a path of the waterjet passing through the waterjet passage during operation.

21. The cutting head assembly of claim 16 wherein the environment control passage of the nozzle component includes a generally annular portion that encircles the waterjet passage and a plurality of distinct sub-passageways each extending between the generally annular portion and an external environment.

22. The cutting head assembly of claim 21 wherein each distinct sub-passageway of the environment control passage of the nozzle component includes a downstream end configured to discharge gas to impinge on the workpiece at or adjacent the waterjet impingement location.

23. The cutting head assembly of claim 16 wherein the environment control passage of the nozzle component includes a plurality of distinct sub-passageways that are configured to simultaneously discharge gas from a common pressurized gas source to impinge on the workpiece at or adjacent the waterjet impingement location during operation.

24. The cutting head assembly of claim 16 wherein the nozzle component further includes a nozzle body cavity and a vent passage extending between the nozzle body cavity and an external environment.

25. The cutting head assembly of claim 16, further comprising:

a mixing tube removably coupled to the nozzle component within the waterjet passage thereof to receive the high-pressure waterjet along with abrasive media from the at least one jet alteration passage, to mix the high-pressure water jet and the abrasive media, and to discharge a resulting abrasive waterjet therefrom to impinge on the workpiece.

* * * * *